US009739050B1

(12) United States Patent
Hensley et al.

(10) Patent No.: US 9,739,050 B1
(45) Date of Patent: Aug. 22, 2017

(54) FLEXIBLE EXPANSION JOINT SEAL SYSTEM

(71) Applicant: EMSEAL JOINT SYSTEMS LTD., Westborough, MA (US)

(72) Inventors: Lester Hensley, Westborough, MA (US); Walter Jones, Northborough, MA (US)

(73) Assignee: EMSEAL JOINT SYSTEMS LTD., Westborough, MA (US)

( * ) Notice: Subject to any disclaimer, the term of this patent is extended or adjusted under 35 U.S.C. 154(b) by 0 days.

(21) Appl. No.: 14/211,694

(22) Filed: Mar. 14, 2014

Related U.S. Application Data

(63) Continuation-in-part of application No. 13/652,021, filed on Oct. 15, 2012, now Pat. No. 9,322,163.

(60) Provisional application No. 61/788,866, filed on Mar. 15, 2013, provisional application No. 61/547,476, filed on Oct. 14, 2011.

(51) Int. Cl.
*E04B 1/68* (2006.01)

(52) U.S. Cl.
CPC ..... *E04B 1/6803* (2013.01); *E04B 1/6815* (2013.01)

(58) Field of Classification Search
CPC .... E04D 13/151; E04B 1/6807; E04B 1/6813
See application file for complete search history.

(56) References Cited

U.S. PATENT DOCUMENTS

| | | | |
|---|---|---|---|
| 517,701 | A | 4/1894 | Knower |
| 945,914 | A | 4/1909 | Colwell |
| 1,357,713 | A | 11/1920 | Lane |
| 1,371,727 | A | 3/1921 | Blickle |

(Continued)

FOREIGN PATENT DOCUMENTS

| | | |
|---|---|---|
| CA | 1280007 | 4/1989 |
| CA | 1334268 | 8/1989 |

(Continued)

OTHER PUBLICATIONS

Lester Hensley, "Where's the Beef in Joint Sealants? Hybrids Hold the Key," Applicator, vol. 23, No. 2, Spring 2001, pp. 1-5.

(Continued)

*Primary Examiner* — Elizabeth A Quast
(74) *Attorney, Agent, or Firm* — MKG LLC

(57) ABSTRACT

A watertight, integrated wall and roof expansion joint seal system includes an expansion joint seal for a structure. The seal includes a central portion having an underside and at least one central chamber disposed around a centerline, a first flange portion extending outwardly from the centerline and a second flange portion extending outwardly from the centerline in a direction opposite the first flange portion. The expansion joint seal includes a fold including a first fold portion and a second fold portion, wherein the first fold portion of the first flange portion is attachable to a first surface of a first substrate of the structure and the second fold portion of the first flange portion is attachable to a second surface of a the first substrate, and the first fold portion of the second flange portion is attachable to a first surface of a second substrate of the structure and the second fold portion of the second flange portion is attachable to a second surface of the second substrate, such that the central portion is disposed within and seals a gap formed between (Continued)

the first substrate and the second substrate of the structure. The system further includes a joint closure.

15 Claims, 21 Drawing Sheets

(56) References Cited

U.S. PATENT DOCUMENTS

| | | | |
|---|---|---|---|
| 1,428,881 | A | 9/1922 | Dyar |
| 1,691,402 | A | 11/1928 | Oden |
| 1,716,994 | A | 6/1929 | Wehrle |
| 1,809,613 | A | 6/1931 | Walker |
| 2,010,569 | A | 8/1935 | Sitzler |
| 2,016,858 | A | 10/1935 | Hall |
| 2,035,476 | A | 3/1936 | Herwood |
| 2,152,189 | A | 4/1936 | Henderson |
| 2,069,899 | A | 2/1937 | Older |
| 2,190,532 | A | 2/1940 | Lukomski |
| 2,240,787 | A | 5/1941 | Kinzer |
| 2,271,180 | A | 1/1942 | Brugger |
| 2,277,286 | A | 3/1943 | Bechtner |
| 2,544,532 | A | 3/1951 | Hill |
| 2,701,155 | A | 2/1955 | Estel, Jr. |
| 2,776,865 | A | 1/1957 | Anderson |
| 2,828,235 | A | 3/1958 | Holland et al. |
| 2,954,592 | A | 10/1960 | Parsons |
| 2,995,056 | A | 10/1960 | Knox |
| 3,024,504 | A | 3/1962 | Miller |
| 3,080,540 | A | 3/1963 | McFarland |
| 3,111,069 | A | 11/1963 | Farbish |
| 3,124,047 | A | 3/1964 | Graham |
| 3,172,237 | A | 3/1965 | Bradley |
| 3,194,846 | A | 7/1965 | Blaga |
| 3,232,786 | A | 2/1966 | Kellman |
| 3,244,130 | A | 4/1966 | Hippie, Jr. |
| 3,245,328 | A | 4/1966 | Fassbinder |
| 3,255,680 | A | 6/1966 | Cooper et al. |
| 3,262,894 | A | 7/1966 | Green |
| 3,289,374 | A | 12/1966 | Metz |
| 3,298,653 | A | 1/1967 | Omholt |
| 3,300,913 | A | 1/1967 | Patry et al. |
| 3,302,690 | A | 2/1967 | Hurd |
| 3,335,647 | A | 8/1967 | Thorp, Jr. |
| 3,344,011 | A | 9/1967 | Goozner |
| 3,352,217 | A | 11/1967 | Peters et al. |
| 3,355,846 | A | 12/1967 | Tillson |
| 3,363,383 | A | 1/1968 | Barge |
| 3,371,456 | A | 3/1968 | Balzer et al. |
| 3,372,521 | A | 3/1968 | Thom |
| 3,378,958 | A | 4/1968 | Parks et al. |
| 3,394,639 | A | 7/1968 | Viehmann |
| 3,410,037 | A | 11/1968 | Empson et al. |
| 3,435,574 | A | 4/1969 | Hallock |
| 3,447,430 | A | 6/1969 | Gausepohl |
| 3,470,662 | A | 10/1969 | Kellman |
| 3,482,492 | A | 12/1969 | Bowman |
| 3,543,459 | A | 12/1970 | Mills |
| 3,551,009 | A | 12/1970 | Cammuso et al. |
| 3,575,372 | A | 4/1971 | Emberson |
| 3,582,095 | A | 6/1971 | Bogaert et al. |
| 3,603,048 | A | 9/1971 | Hadfield |
| 3,604,322 | A | 9/1971 | Koster |
| 3,606,826 | A | 9/1971 | Bowman |
| 3,629,986 | A | 12/1971 | Klittich |
| 3,643,388 | A | 2/1972 | Parr et al. |
| 3,659,390 | A | 5/1972 | Balzer et al. |
| 3,670,470 | A | 6/1972 | Thom |
| 3,672,707 | A | 6/1972 | Russo et al. |
| 3,677,145 | A | 7/1972 | Wattiez |
| 3,694,976 | A | 10/1972 | Warshaw |
| 3,712,188 | A | 1/1973 | Worson |
| 3,720,142 | A | 3/1973 | Pare |
| 3,736,713 | A | 6/1973 | Flachbarth et al. |
| 3,742,669 | A | 7/1973 | Mansfeld |
| 3,745,726 | A | 7/1973 | Thom |
| 3,750,359 | A | 8/1973 | Balzer et al. |
| 3,760,544 | A | 9/1973 | Hawes et al. |
| 3,797,188 | A | 3/1974 | Mansfeld |
| 3,849,958 | A | 11/1974 | Balzer et al. |
| 3,856,839 | A | 12/1974 | Smith et al. |
| 3,871,787 | A | 3/1975 | Stegmeier |
| 3,880,539 | A | 4/1975 | Brown |
| 3,883,475 | A | 5/1975 | Racky et al. |
| 3,896,511 | A | 7/1975 | Cuschera |
| 3,907,443 | A | 9/1975 | McLean |
| 3,911,635 | A | 10/1975 | Traupe |
| 3,934,905 | A | 1/1976 | Lockard |
| 3,944,704 | A | 3/1976 | Dirks |
| 3,951,562 | A | 4/1976 | Fyfe |
| 3,956,557 | A | 5/1976 | Hurst |
| 3,974,609 | A | 8/1976 | Attaway |
| 4,007,994 | A | 2/1977 | Brown |
| 4,018,017 | A | 4/1977 | Schoop |
| 4,018,539 | A | 4/1977 | Puccio |
| 4,022,538 | A | 5/1977 | Watson et al. |
| 4,030,156 | A | 6/1977 | Raymond |
| 4,055,925 | A | 11/1977 | Wasserman et al. |
| 4,058,947 | A | 11/1977 | Earle et al. |
| 4,066,578 | A | 1/1978 | Murch et al. |
| 4,129,967 | A | 12/1978 | Barlow |
| 4,132,491 | A | 1/1979 | Scheffel |
| 4,134,875 | A | 1/1979 | Tapia |
| 4,140,419 | A | 2/1979 | Puccio |
| 4,143,088 | A | 3/1979 | Favre et al. |
| 4,146,939 | A | 4/1979 | Izzi |
| 4,174,420 | A | 11/1979 | Anolick et al. |
| 4,181,711 | A | 1/1980 | Ohashi et al. |
| 4,204,856 | A | 5/1980 | Yigdall et al. |
| 4,221,502 | A | 9/1980 | Tanikawa |
| 4,224,374 | A | 9/1980 | Priest |
| 4,237,182 | A | 12/1980 | Fulmer et al. |
| 4,245,925 | A | 1/1981 | Pyle |
| 4,246,313 | A | 1/1981 | Stengle, Jr. |
| 4,258,606 | A | 3/1981 | Wilson |
| 4,270,318 | A | 6/1981 | Carroll et al. |
| 4,271,650 | A | 6/1981 | Lynn-Jones |
| 4,288,559 | A | 9/1981 | Illger et al. |
| 4,290,249 | A | 9/1981 | Mass |
| 4,290,713 | A | 9/1981 | Brown et al. |
| 4,295,311 | A | 10/1981 | Dahlberg |
| 4,305,680 | A | 12/1981 | Rauchfuss, Jr. |
| 4,320,611 | A | 3/1982 | Freeman |
| 4,359,847 | A | 11/1982 | Schukolinski |
| 4,362,428 | A | 12/1982 | Kerschner |
| 4,367,976 | A | 1/1983 | Bowman |
| 4,374,207 | A | 2/1983 | Stone et al. |
| 4,374,442 | A | 2/1983 | Hein et al. |
| 4,401,716 | A | 8/1983 | Tschudin-Mahrer |
| 4,424,956 | A | 1/1984 | Grant et al. |
| 4,431,691 | A | 2/1984 | Greenlee |
| 4,432,465 | A | 2/1984 | Wuertz |
| 4,433,732 | A | 2/1984 | Licht et al. |
| 4,447,172 | A | 5/1984 | Galbreath |
| 4,453,360 | A | 6/1984 | Barenberg |
| 4,455,396 | A | 6/1984 | Al-Tabaqchall et al. |
| 4,473,015 | A | 9/1984 | Hounsel |
| 4,486,994 | A | 12/1984 | Fisher et al. |
| 4,494,762 | A | 1/1985 | Geipel |
| 4,533,278 | A | 8/1985 | Corsover et al. |
| 4,558,875 | A | 12/1985 | Yamaji et al. |
| 4,564,550 | A | 1/1986 | Tschudin-Mahrer |
| 4,566,242 | A | 1/1986 | Dunsworth |
| 4,576,841 | A | 3/1986 | Lingemann |
| 4,589,242 | A | 5/1986 | Moulinie et al. |
| 4,615,411 | A | 10/1986 | Breitscheidel et al. |
| 4,620,330 | A | 11/1986 | Izzi, Sr. |
| 4,620,407 | A | 11/1986 | Schmid |
| 4,622,251 | A | 11/1986 | Gibb |
| 4,637,085 | A | 1/1987 | Hartkorn |
| 4,687,829 | A | 8/1987 | Chaffee et al. |
| 4,693,652 | A | 9/1987 | Sweeney |
| 4,711,928 | A | 12/1987 | Lee et al. |
| 4,717,050 | A | 1/1988 | Wright |
| 4,745,711 | A | 5/1988 | Box |

(56) References Cited

U.S. PATENT DOCUMENTS

| | | | |
|---|---|---|---|
| 4,751,024 | A | 6/1988 | Shu et al. |
| 4,756,945 | A | 7/1988 | Gibb |
| 4,767,655 | A | 8/1988 | Tschudin-Mahrer |
| 4,773,791 | A | 9/1988 | Hartkorn |
| 4,780,571 | A | 10/1988 | Huang |
| 4,781,003 | A | 11/1988 | Rizza |
| 4,784,516 | A | 11/1988 | Cox |
| 4,791,773 | A | 12/1988 | Taylor |
| 4,807,843 | A | 2/1989 | Courtois et al. |
| 4,815,247 | A | 3/1989 | Nicholas |
| 4,824,283 | A | 4/1989 | Belangie |
| 4,835,130 | A | 5/1989 | Box |
| 4,839,223 | A | 6/1989 | Tschudin-Mahrer |
| 4,848,044 | A | 7/1989 | LaRoche et al. |
| 4,849,223 | A | 7/1989 | Pratt et al. |
| 4,866,898 | A | 9/1989 | LaRoche et al. |
| 4,879,771 | A | 11/1989 | Piskula |
| 4,882,890 | A | 11/1989 | Rizza |
| 4,885,885 | A | 12/1989 | Gottschling |
| 4,893,448 | A | 1/1990 | McCormick |
| 4,901,488 | A | 2/1990 | Murota et al. |
| 4,911,585 | A | 3/1990 | Vidal et al. |
| 4,916,878 | A | 4/1990 | Nicholas |
| 4,920,725 | A | 5/1990 | Gore |
| 4,927,291 | A | 5/1990 | Belangie |
| 4,932,183 | A | 6/1990 | Coulston |
| 4,942,710 | A | 7/1990 | Rumsey |
| 4,952,615 | A | 8/1990 | Welna |
| 4,957,798 | A | 9/1990 | Bogdany |
| 4,965,976 | A | 10/1990 | Riddle et al. |
| 4,977,018 | A | 12/1990 | Irrgeher et al. |
| 4,992,481 | A | 2/1991 | von Bonin et al. |
| 5,007,765 | A | 4/1991 | Dietlein et al. |
| 5,013,377 | A | 5/1991 | Lafond |
| 5,024,554 | A | 6/1991 | Benneyworth et al. |
| 5,026,609 | A | 6/1991 | Jacob et al. |
| 5,035,097 | A | 7/1991 | Cornwall |
| 5,053,442 | A | 10/1991 | Chu et al. |
| 5,060,439 | A | 10/1991 | Clements et al. |
| 5,071,282 | A | 12/1991 | Brown |
| 5,072,557 | A | 12/1991 | Naka et al. |
| 5,082,394 | A | 1/1992 | George |
| 5,094,057 | A | 3/1992 | Morris |
| 5,115,603 | A | 5/1992 | Blair |
| 5,120,584 | A | 6/1992 | Ohlenforst et al. |
| 5,121,579 | A | 6/1992 | Hamar et al. |
| 5,129,754 | A | 7/1992 | Brower |
| 5,130,176 | A | 7/1992 | Baerveldt |
| 5,137,937 | A | 8/1992 | Huggard et al. |
| 5,140,797 | A | 8/1992 | Gohlke et al. |
| 5,168,683 | A | 12/1992 | Sansom et al. |
| 5,173,515 | A | 12/1992 | von Bonin et al. |
| 5,190,395 | A | 3/1993 | Cathey et al. |
| 5,209,034 | A | 5/1993 | Box et al. |
| 5,213,441 | A | 5/1993 | Baerveldt |
| 5,222,339 | A | 6/1993 | Hendrickson et al. |
| 5,249,404 | A | 10/1993 | Leek et al. |
| 5,270,091 | A | 12/1993 | Krysiak et al. |
| 5,297,372 | A | 3/1994 | Nicholas |
| 5,327,693 | A | 7/1994 | Schmid |
| 5,335,466 | A | 8/1994 | Langohr |
| 5,338,130 | A | 8/1994 | Baerveldt |
| 5,354,072 | A | 10/1994 | Nicholson |
| 5,365,713 | A | 11/1994 | Nicholas et al. |
| 5,367,850 | A | 11/1994 | Nicholas |
| 5,380,116 | A | 1/1995 | Colonias |
| 5,436,040 | A | 7/1995 | Lafond |
| 5,441,779 | A | 8/1995 | Lafond |
| 5,443,871 | A | 8/1995 | Lafond |
| 5,450,806 | A | 9/1995 | Jean |
| 5,456,050 | A | 10/1995 | Ward |
| 5,472,558 | A | 12/1995 | Lafond |
| 5,479,745 | A | 1/1996 | Kawai et al. |
| 5,485,710 | A | 1/1996 | Lafond |
| 5,489,164 | A | 2/1996 | Tusch et al. |
| 5,491,953 | A | 2/1996 | Lafond |
| 5,498,451 | A | 3/1996 | Lafond |
| 5,501,045 | A | 3/1996 | Wexler |
| 5,508,321 | A | 4/1996 | Brebner |
| 5,528,867 | A | 6/1996 | Thompson |
| RE35,291 | E | 7/1996 | Lafond |
| 5,572,920 | A | 11/1996 | Kennedy et al. |
| 5,607,253 | A | 3/1997 | Almstrom |
| 5,611,181 | A | 3/1997 | Shreiner et al. |
| 5,616,415 | A | 4/1997 | Lafond |
| 5,628,857 | A | 5/1997 | Baerveldt |
| 5,635,019 | A | 6/1997 | Lafond |
| 5,649,784 | A | 7/1997 | Ricaud et al. |
| 5,650,029 | A | 7/1997 | Lafond |
| 5,656,358 | A | 8/1997 | Lafond |
| 5,658,645 | A | 8/1997 | Lafond |
| 5,664,906 | A | 9/1997 | Baker et al. |
| 5,680,738 | A | 10/1997 | Allen et al. |
| 5,686,174 | A | 11/1997 | Irrgeher |
| 5,691,045 | A | 11/1997 | Lafond |
| 5,744,199 | A | 4/1998 | Joffre et al. |
| 5,759,665 | A | 6/1998 | Lafond |
| 5,762,738 | A | 6/1998 | Lafond |
| 5,765,332 | A | 6/1998 | Landin et al. |
| 5,773,135 | A | 6/1998 | Lafond |
| 5,791,111 | A | 8/1998 | Beenders |
| 5,806,272 | A | 9/1998 | Lafond |
| 5,813,191 | A | 9/1998 | Gallagher |
| 5,830,319 | A | 11/1998 | Landin |
| 5,851,609 | A | 12/1998 | Baratuci et al. |
| 5,875,598 | A | 3/1999 | Batten et al. |
| 5,876,554 | A | 3/1999 | Lafond |
| 5,878,448 | A | 3/1999 | Molter |
| 5,887,400 | A | 3/1999 | Bratek et al. |
| 5,888,341 | A | 3/1999 | Lafond |
| 5,935,695 | A | 8/1999 | Baerveldt |
| 5,957,619 | A | 9/1999 | Kinoshita et al. |
| 5,974,750 | A | 11/1999 | Landin et al. |
| 5,975,181 | A | 11/1999 | Lafond |
| 6,001,453 | A | 12/1999 | Lafond |
| 6,014,848 | A | 1/2000 | Hilburn, Jr. |
| 6,035,536 | A | 3/2000 | Dewberry |
| 6,035,587 | A | 3/2000 | Dressler |
| 6,035,602 | A | 3/2000 | Lafond |
| 6,039,503 | A | 3/2000 | Cathey |
| D422,884 | S | 4/2000 | Lafond |
| 6,088,972 | A | 7/2000 | Johanneck |
| 6,102,407 | A | 8/2000 | Moriya et al. |
| 6,115,980 | A | 9/2000 | Knak et al. |
| 6,115,989 | A | 9/2000 | Boone et al. |
| 6,128,874 | A | 10/2000 | Olson et al. |
| 6,131,352 | A | 10/2000 | Barnes et al. |
| 6,131,364 | A | 10/2000 | Peterson |
| 6,131,368 | A | 10/2000 | Tramposch et al. |
| 6,138,427 | A | 10/2000 | Houghton |
| 6,148,890 | A | 11/2000 | Lafond |
| 6,158,915 | A | 12/2000 | Kise |
| 6,189,573 | B1 | 2/2001 | Ziehm |
| 6,192,652 | B1 | 2/2001 | Goer et al. |
| 6,207,085 | B1 | 3/2001 | Ackerman |
| 6,207,089 | B1 | 3/2001 | Chuang |
| 6,219,982 | B1 | 4/2001 | Eyring |
| 6,237,303 | B1 | 5/2001 | Allen et al. |
| 6,250,358 | B1 | 6/2001 | Lafond |
| 6,253,514 | B1 | 7/2001 | Jobe et al. |
| 6,329,030 | B1 | 12/2001 | Lafond |
| 6,350,373 | B1 | 2/2002 | Sondrup |
| 6,351,923 | B1 | 3/2002 | Peterson |
| 6,355,328 | B1 | 3/2002 | Baratuci et al. |
| 6,368,670 | B1 | 4/2002 | Frost et al. |
| 6,419,237 | B1 | 7/2002 | More |
| 6,439,817 | B1 | 8/2002 | Reed |
| 6,443,495 | B1 | 9/2002 | Harmeling |
| 6,460,214 | B1 | 10/2002 | Chang |
| 6,491,468 | B1 | 12/2002 | Hagen |
| 6,499,265 | B2 | 12/2002 | Shreiner |
| 6,532,708 | B1 | 3/2003 | Baerveldt |
| 6,544,445 | B1 | 4/2003 | Graf et al. |
| 6,552,098 | B1 | 4/2003 | Bosch et al. |

(56) References Cited

U.S. PATENT DOCUMENTS

| | | | |
|---|---|---|---|
| 6,574,930 | B2 | 6/2003 | Kiser |
| 6,581,341 | B1 | 6/2003 | Baratuci et al. |
| 6,598,364 | B1 | 7/2003 | Pelles |
| 6,665,995 | B2 | 12/2003 | Deane |
| 6,666,618 | B1 | 12/2003 | Anaya et al. |
| 6,685,196 | B1 | 2/2004 | Baerveldt |
| 6,820,382 | B1 | 11/2004 | Chambers et al. |
| 6,860,074 | B2 | 3/2005 | Stanchfield |
| 6,862,863 | B2 | 3/2005 | McCorkle et al. |
| 6,877,292 | B2 | 4/2005 | Baratuci et al. |
| 6,897,169 | B2 | 5/2005 | Matsui et al. |
| 6,905,650 | B2 | 6/2005 | McIntosh et al. |
| 6,948,287 | B2 | 9/2005 | Korn |
| 6,989,188 | B2 | 1/2006 | Brunnhofer et al. |
| 6,996,944 | B2 | 2/2006 | Shaw |
| 7,043,880 | B2 | 5/2006 | Morgan et al. |
| 7,070,653 | B2 | 7/2006 | Frost et al. |
| 7,090,224 | B2 | 8/2006 | Iguchi et al. |
| 7,101,614 | B2 | 9/2006 | Anton et al. |
| 7,114,899 | B2 | 10/2006 | Gass et al. |
| 7,210,557 | B2 | 5/2007 | Phillips et al. |
| 7,222,460 | B2 | 5/2007 | Francies, III et al. |
| 7,225,824 | B2 | 6/2007 | West et al. |
| 7,240,905 | B1 | 7/2007 | Stahl, Sr. |
| 7,278,450 | B1 | 10/2007 | Condon |
| 7,287,738 | B2 | 10/2007 | Pitlor |
| 7,441,375 | B2 | 10/2008 | Lang |
| 7,621,731 | B2 | 11/2009 | Armantrout et al. |
| 7,665,272 | B2 | 2/2010 | Reen |
| 7,678,453 | B2 | 3/2010 | Ohnstad et al. |
| 7,748,310 | B2 | 7/2010 | Kennedy |
| 7,757,450 | B2 | 7/2010 | Reyes et al. |
| 7,836,659 | B1 | 11/2010 | Barnes |
| 7,856,781 | B2 | 12/2010 | Hilburn, Jr. |
| 7,877,958 | B2 | 2/2011 | Baratuci et al. |
| 7,941,981 | B2 | 5/2011 | Shaw |
| 8,033,073 | B1 | 10/2011 | Binder |
| 8,079,190 | B2 | 12/2011 | Hilburn, Jr. |
| 8,171,590 | B2 | 5/2012 | Kim |
| 8,172,938 | B2 | 5/2012 | Alright et al. |
| 8,317,444 | B1 | 11/2012 | Hensley |
| 8,333,532 | B2 | 12/2012 | Derrigan et al. |
| 8,341,908 | B1 | 1/2013 | Hensley et al. |
| 8,365,495 | B1 | 2/2013 | Witherspoon |
| 8,397,453 | B2 | 3/2013 | Shaw |
| 8,601,760 | B2 | 12/2013 | Hilburn, Jr. |
| 8,720,138 | B2 | 5/2014 | Hilburn, Jr. |
| 8,739,495 | B1 | 6/2014 | Witherspoon |
| 8,813,449 | B1 | 8/2014 | Hensley et al. |
| 8,813,450 | B1 | 8/2014 | Hensley et al. |
| 9,068,297 | B2 | 6/2015 | Hensley et al. |
| 9,200,437 | B1 | 12/2015 | Hensley et al. |
| 2002/0052425 | A1 | 5/2002 | Kaku et al. |
| 2002/0088192 | A1 | 7/2002 | Calixto |
| 2002/0095908 | A1 | 7/2002 | Kiser |
| 2002/0113143 | A1 | 8/2002 | Frost et al. |
| 2002/0193552 | A1 | 12/2002 | Kiuchi et al. |
| 2003/0005657 | A1 | 1/2003 | Visser et al. |
| 2003/0110723 | A1 | 6/2003 | Baerveldt |
| 2003/0213211 | A1 | 11/2003 | Morgan et al. |
| 2004/0020162 | A1 | 2/2004 | Baratuci et al. |
| 2004/0045234 | A1 | 3/2004 | Morgan et al. |
| 2004/0101672 | A1 | 5/2004 | Anton et al. |
| 2004/0113390 | A1 | 6/2004 | Broussard, III |
| 2005/0066600 | A1 | 3/2005 | Moulton et al. |
| 2005/0120660 | A1 | 6/2005 | Kim et al. |
| 2005/0155305 | A1 | 7/2005 | Cosenza et al. |
| 2005/0193660 | A1 | 9/2005 | Mead |
| 2005/0222285 | A1 | 10/2005 | Massengill et al. |
| 2006/0010817 | A1 | 1/2006 | Shull |
| 2006/0030227 | A1 | 2/2006 | Hairston et al. |
| 2006/0117692 | A1 | 6/2006 | Trout |
| 2006/0178064 | A1 | 8/2006 | Balthes et al. |
| 2007/0059516 | A1 | 3/2007 | Vincent et al. |
| 2007/0137135 | A1 | 6/2007 | Shymkowich |
| 2007/0199267 | A1 | 8/2007 | Moor |
| 2007/0261342 | A1 | 11/2007 | Cummings |
| 2008/0172967 | A1 | 7/2008 | Hilburn |
| 2008/0193738 | A1 | 8/2008 | Hensley et al. |
| 2008/0268231 | A1 | 10/2008 | Deib |
| 2009/0036561 | A1 | 2/2009 | Nygren |
| 2009/0223150 | A1 | 9/2009 | Baratuci et al. |
| 2009/0223159 | A1 | 9/2009 | Colon |
| 2009/0246498 | A1 | 10/2009 | Deiss |
| 2009/0315269 | A1 | 12/2009 | Deiss |
| 2010/0058696 | A1 | 3/2010 | Mills |
| 2010/0275539 | A1 | 11/2010 | Shaw |
| 2010/0281807 | A1 | 11/2010 | Bradford |
| 2010/0319287 | A1 | 12/2010 | Shaw |
| 2011/0016808 | A1 | 1/2011 | Hulburn, Jr. |
| 2011/0083383 | A1 | 4/2011 | Hilburn, Jr. |
| 2011/0088342 | A1 | 4/2011 | Stahl, Sr. et al. |
| 2011/0135387 | A1 | 6/2011 | Derrigan et al. |
| 2011/0247281 | A1 | 10/2011 | Pilz et al. |
| 2012/0117900 | A1 | 5/2012 | Shaw |
| 2014/0151968 | A1 | 6/2014 | Hensley et al. |
| 2014/0219719 | A1 | 8/2014 | Hensley et al. |
| 2014/0360118 | A1 | 12/2014 | Hensley et al. |

FOREIGN PATENT DOCUMENTS

| | | | |
|---|---|---|---|
| CA | 1259351 | A | 9/1989 |
| CA | 1280007 | | 2/1991 |
| CA | 2256660 | A1 | 2/2000 |
| CA | 2296779 | C | 11/2006 |
| CA | 2640007 | A1 | 3/2009 |
| DE | 4436280 | A1 | 4/1996 |
| DE | 19809973 | C1 | 7/1999 |
| DE | 102005054375 | A1 | 5/2007 |
| EP | 0976882 | A2 | 2/1999 |
| EP | 0942107 | A2 | 9/1999 |
| EP | 1118715 | A1 | 7/2001 |
| EP | 1118726 | A1 | 7/2001 |
| EP | 1540220 | | 2/2004 |
| EP | 1540220 | B1 | 8/2006 |
| EP | 1983119 | A1 | 4/2007 |
| EP | 1983119 | B1 | 10/2008 |
| GB | 977929 | | 12/1964 |
| GB | 1359734 | | 7/1974 |
| GB | 1495721 | | 12/1977 |
| GB | 1519795 | | 8/1978 |
| GB | 2181093 | A | 4/1987 |
| GB | 2251623 | A1 | 7/1992 |
| GB | 2359265 | A | 8/2001 |
| GB | 2377379 | A | 1/2003 |
| JP | 200645950 | A | 2/2006 |
| WO | 2003006109 | A1 | 1/2003 |
| WO | 2007023118 | A2 | 3/2007 |
| WO | 2007024246 | A1 | 3/2007 |

OTHER PUBLICATIONS

Emseal Joint Systems, LTD, Seismic Colorseal, Tech Data, Apr. 1998, pp. 1-2.

Schul International Co., LLC, Sealtite VP Premium Quality Pre-compressed Joint Sealant for Weather tight, Vapor Permeable, Vertical Applications, Technical Data, dated Oct. 28, 2005, pp. 1-2.

Schul International Co., LLC, Seismic Sealtite II, Colorized, Pre-compressed Joint Sealant for Vertical Applications, Technical Data, dated Sep. 20, 2006, pp. 1-2.

Dow Corning Corporation, Dow Corning 790 Silicone Building Sealant, copyright date 1995, 1999, pp. 1-5.

Emseal Joint Systems, LTD, Horizontal Colorseal, Tech Data, Nov. 2008, pp. 1-2.

Emseal Joint Systems, LTD, Seismic Colorseal, Tech Data, Jul. 2009, pp. 1-2.

Emseal Joint Systems, LTD, Horizontal Colorseal, Tech Data, Jul. 2009, pp. 1-2.

Emseal Joint Systems, LTD, Horizontal Colorseal, Tech Data, Jun. 2010, pp. 1-2.

Schul International Co., LLC, Sealtite "B", Pre-compressed Joint

(56) References Cited

OTHER PUBLICATIONS

Sealant, Premium Quality for Secondary Sealant Applications, Technical Data, dated Oct. 28, 2005, pp. 1-2.
ISO-Chemie GmbH, ISO-Flame Kombi F 120, 2006, German, pp. 1-2.
ISO-Chemie GmbH, Order Confirmation Sheet, dated Apr. 26, 2007, pp. 1-3.
ISO-Flame Kombi F 120, Net Price List, Schul International Co., dated Jun. 27, 2006, pp. 1.
Tremco Illbruck Limited, Compriband Super FR, Fire Rated Acrylic Impregnated Foam Sealant Strip, Issue 3, dated Apr. 12, 2007, pp. 1-2.
Schul International Co., LLC, Sealtite 50N, Premium Quality Pre-compressed Joint Sealant for Horizontal Applications, dated Oct. 28, 2005, pp. 1-2.
Will-Seal, Signed, Sealed & Delivered, pp. 1.
Illbruck/USA, Will-Seal 150 Impregnanted Precompressed Expanding Foam Sealant Tape, Spec-Data Sheet, Joint Sealers, dated Nov. 1987, pp. 1-2.
Illbruck, Inc., Will-Seal 250 Impregnanted Precompressed Expanding Foam Sealant Tape, Spec-Data Sheet, Joint Sealers, dated Aug. 1989, pp. 1-2.
U.S. Department of Labor, Material Safety Data Sheet, Identity: Willseal 150/250 and/or E.P.S., date prepared Jul. 21, 1986, pp. 1-2.
Illbruck, TechSpec Division Facade & Roofing Solutions, ALFAS compriband, Mar. 2005, pp. 1-10.
Dow Corning Corporation, Dow Corning 790 Silicone Building Sealant, copyright 2000-2005, pp. 1-2.
Grace Fireproofing Products. Monokote Z-146T. 2007, pp. 1-2.
Polyurethane Foam Field Joint Infill Systems, Sep. 23, 2007 (via Snagit), PIH, pp. 1-5.
International Search Report and Written Opinion for PCT/US2014/032212, Aug. 25, 2014, pp. 1-13.
Grunau Illertissen GMBH, Fir-A-Flex, Fire Protection for Linear Gaps in Walls and Ceilings, dated Aug. 1996, pp. 1-4.
UL Standard for Safety for Rests for Fire Resistance of Building Joint Systems, UL 2079, Underwriters Laboratories Inc. (UL); Fourth Edition; dated Oct. 21. 2004.
Emseal "Pre-cured-Caulk-and-Backerblock" Not New, Not Equal to Emseal's Colorseal, Jul. 19, 2012.
Emseal Drawing Part No. 010-0-00-00 dated Dec. 6, 2005.
Emseal Horizontal Colorseal Tech Data, dated Jun. 1997.
Emseal Joint Systems, Drawing SJS-100-CHT-N, Nov. 20, 2007.
Emseal Technical Bulletin, Benchmarks of Performance for High-Movement Acrylic-Impregnated, Precompressed, Foam Sealants when Considering Substitutions, Jul. 3, 2012.
Emseal, Colorseal & Seismic Colorseal, May 1997, Install Data Colorseal & Seismic Colorseal, p. 1-2.
Emseal, Colorseal, Jan. 2000, Colorseal TechData, p. 1-2.
Emseal, Is there a gap in your air barrier wall design?, Jul. 19, 2012.
Manfredi, L. "Thermal Degradation and Fire Resistance of Unsaturated Polyester, Modified Acrylic Resins and their Composites with Natural Fibres"; Science Direct, 2005.
Din 4102, Part 2, Fire Behaviour of Building Materials and Building Components, Sep. 1977.
Emseal Joint Systems, Ltd., Material Safety Data Sheet for AST-HI-Acrylic, Apr. 2002, pp. 1-2.
ISO-Chemie, GmbH., Iso-Bloco 600, pp. 1-2.
ISO-Chemie, GmbH., Iso-Flame Kombi F 120, pp. 1-2., 2006.
Underwriters Laboratories Inc., UL Standard for Safety for Fire Tests of Building Construction and Materials, UL 263, Thirteenth Edition, Apr. 4, 2003, pp. 1-40.
Adolf Wurth GmbH & Co., KG, Elastic Joint Sealing Tape, labeled Copyright 2000-2003, pp. 1-7. X.
Expanding PU Foam, Technical Data Sheet, Feb. 1997, pp. 1-2.
ASTM International, Designation: E 84-04, Standard Test Method for Surface Burning Characteristics of Building Materials, Feb. 2004, pp. 1-19.
ASTM International, Designation: E 176-07, Standard Terminology of Fire Standards, Oct. 2007, pp. 1-20.
Auburn Manufacturing Company, Auburn Product News, Flame Retardant Silicone Sponge, 2007, p. 1.
British Board of Agrement, Agrement Certificate No. 97/3331, Second Issue, Compriband Super, 2005, pp. 1-4.
British Board of Agrement, Agrement Certificate No. 96/3309, Third Issue, Illmod 600 Sealing Tapes, 2003, pp. 1-8.
Nederland Normalistie-Instituut, Experimental Determination of the Fire Resistance of Elements of Building Construction, Nen 6069, Oct. 1991, English Translation, pp. 1-30.
British Standards Institution, Fire Tests on Building Materials and Structures, BS 476: Part 20: 1987, pp. 1-44.
DIN Deutsches Institut for Normung e.V., DIN 18542, Impregnated Cellular Plastics Strips for Sealing External Joints, Requirements and Testing, Jan. 1999, pp. 1-10.
www.BuildingTalk.com, Emseal Joint Systems, Choosing a Sealant for Building Applicaitons, Hensley. May 21, 2007, pp. 1-6.
Netherlands Organization for Applied Scientific Research (TNO), Determination of the Fire Resistance According to NEN 6069 of Joints in a Wall Sealed with Cocoband 6069 Impregnated Foam Strip, Nov. 1996, pp. 1-19.
DIN Deutsches Institut fur Normung e.V., Fire Behaviour of Building Materials and Elements, Part 1: Classification of Building Materials, Requirements and Testing, DIN 4102-1, May 1998, pp. 1-33.
DIN Deutsches Institut fur Normung e.V., Fire Behaviour of Building Materials and Elements, Overview and Design of Classified Building Materials, Elements and Components, DIN 4102-4, Mar. 1994, pp. 1-144.
Dow Corning Corporation, Dow Corning 790, Silicone Building Sealant, labeled Copyright 2000, pp. 1-6.
Dow Corning Corporation, Dow Corning 790, Silicone Building Sealant, Product Information, labeled Copyright 2000-2004, pp. 1-4.
Dow Corning Corporation, Dow Corning Firestop 400 Acrylic Sealant, 2001, pp. 1-4.
Dow Corning Corporation, Dow Corning Firestop 700 Silicone Sealant, 2001, pp. 1-6.
Emseal Joint Systems, Horizontal Colorseal, Aug. 2000, pp. 1-2.
Emseal Joint Systems, Ltd., Colorseal PC/SA Stick STD/001-0-00-00, 1995, p. 1.
Emseal Joint Systems, Ltd., 20H System, Tech Data, Jun. 1997, pp. 1-2.
Emseal Joint Systems Ltd. Colorseal, Aug. 2000, pp. 1-2.
Emseal Joint Systems, Ltd., DSH System, Watertight Joint System for Decks, Tech Data, Nov. 2005, pp. 1-2.
Emseal Joint Systems, Ltd., Fire-Rating of Emseal 20H System, Feb. 17, 1993, p. 1-2.
Emseal Joint Systems, Ltd., Preformed Sealants and Expansion Joint Systems, May 2002, pp. 1-4.
Emseal Joint Systems, Ltd., Pre-Formed Sealants and Expansion Joints, Jan. 2002, pp. 1-4.
Emseal Joint Systems, Ltd., Seismic Colorseal, Aug. 2000, pp. 1-2.
Emseal Joint Systems, Ltd., Seismic Colorseal-DS (Double-Sided) Apr. 12, 2007, pp. 1-4.
Environmental Seals, Ltd., Envirograf, Fire Kills: Stop it today with fire stopping products for building gaps and openings, 2004, pp. 1-8.
Fire Retardants, Inc., Fire Barrier CP 25WB+Caulk, labeled Copyright 2002, pp. 1-4.
Illbruck Bau-Produkte GmbH u. CO. KG., willseal firestop, Product Information Joint Sealing Tape for the Fire Protection Joint, Sep. 30, 1995, pp. 1-9.
Illbruck, willseal, The Joint Sealing Tape, 1991, pp. 1-19.
Illbruck, willseal 600; Product Data Sheet, 2001 pp. 1-2.
Material Safety Data Sheet, Wilseal 150/250 and/or E.P.S., Jul. 21, 1986, pp. 1-2.
ISO 066, Technical Datasheet, blocostop F-120, 2002 p. 1.
MM Systems, ejp Expansion Joints, Expanding Impregnated Foam System, internet archive, wayback machine, Nov. 16, 2007, pp. 1-2.
MM Systems, ejp Expansion Joints, Colorjoint/SIF—Silicone Impregnated Foam System, internet archive, wayback machine, Nov. 16, 2007, pp. 1-2.
MM Systems, ColorJoint/SIF Series, Silicone Seal & Impregnated Expanding Foam, Spec Data, 2007, pp. 1-3.

(56) References Cited

OTHER PUBLICATIONS

Norton Performance Plastics Corporation, Norseal V740FR, Flame Retardant, UL Recognized Multi-Purpose Foam Sealant, labeled Copyright 1996, pp. 1-2.
Promat International,Ltd., Promaseal FyreStrip, Seals for Movement Joints in Floors/Walls, labeled Copyright 2006, pp. 1-4.
Promat International, Ltd., Promaseal Guide for Linear Gap Seals and Fire Stopping Systems, Jun. 2008, pp. 1-20.
Promat International, Ltd., Promaseal IBS Foam Strip, Penetration Seals on Floors/Walls, labeled Copyright 2004, pp. 1-6.
Promat International, Ltd., Safety Data Sheet, Promaseal IBS, May 25, 2007, pp. 1-3.
Schul International, Co., LLC., Color Econoseal, Technical Data, Premium Quality Joint Sealant for Waterproof Vertical and Horizontal Applicaitons, 2005, pp. 1-2.
Schul International, Co., LLC., Sealtite Airstop FR, Air and Sound Infiltration Barrier, labeled Copyright Apr. 1997, p. 1.
Schul International, Co., LLC., Sealtite Standard, Pre-compressed Joint Sealant, High Density, Polyurethane Foam, Waterproofs Vertical Applications, 2007.
Schul International Co., LLC., Sealtite VP (600) Technical Data, Premium Quality Pre-compressed Joint Sealant for Weather tight, Vapor Permeable, Vertical Applications, labeled Copyright 1997-2002, pp. 1-2.
Schul International Co., LLC., Seismic Sealtite, Technical Data, Colorized, Pre-compressed Joint Sealant for Vertical Applications, 2005, pp. 1-2.
Schul International Co., LLC., Sealtite 50N, Technical Data, Premium Quality Pre-compressed Joint Sealant for Horizontal Applications, labeled Copyright 2002, pp. 1-2.
Schul International Co., LLC., HydroStop, Expansion Joint System, 2005, pp. 1-2.
Schul International Co., LL., Sealtite, The Most Complete Line of Pre-compressed Sealants, web archive.org, wayback machine, printed 2014, pp. 1-3.
Sealant, Waterproofing & Restoration Institute, Sealants: The Professional Guide, labeled Copyright 1995, Chapter II—Sealants, p. 26, pp. 1-3.
Tremco Illbruck, Cocoband 6069, 2007, p. 1 with English translation.
Tremco Illbruck, Alfacryl FR Intumescent Acrylic, Fire Rated, Emulsion Acrylic, Intumescent Sealant, 2007, pp. 1-2.
Tremco Illbruck, Alfasil FR, Fire Rated, Low Modulus, Neutral Cure Silicone Sealant, 2007, pp. 1-2.
Tremco Illbruck, Compriband 600, Impregnated Joint Sealing Tape, 2007, pp. 1-2.
Tremco Illbruck, Compriband Super FR, Fire Rated Acrylic Impregnated Foam Sealant Strip, 2007, pp. 1-2.
Tremco Illbruck, Ltd. Technical Data Sheet, Compriband Super FR, Issue 2, Oct. 18, 10, 2004, pp. 1-4.
Tremco Illbruck, Ltd. Technical Data Sheet, Compriband Super, Issue 1, Sep. 29, 2004, pp. 1-3.
Illbruck, TechSpec Division Facade & Roofing Solutions, Mar. 2005, pp. 1-10.
Tremco Illbruck, Alfas Bond FR, 2007, pp. 1-2.
Tremco Illbruck, Illmod 600, Jun. 2006, pp. 1-2.
Tremco Illbruck, The Specification Product Range, 2007, pp. 1-36.
Tremco Illbruck, Webbflex B1 PU Foam, Fire Rated Expanding Polyurethane Foam, Sep. 11, 2006, pp. 1-2.
UL Online Certifications Directory, System No. WW-S-0007, XHBN.WW-S-0007, Joint Systems, Dec. 5, 1997, pp. 1-3.
UL Online Certifications Directory, BXUV.GuideInfo, Fire-Resistance Ratings ANSI/UL 263, last updated Jun. 26, 2014, pp. 1-24.
Frangi et al., German language, Zum Brandverhalten von Holzdecken aus Hohlkasten-elementen, Institut fur Baustatik und Konstrucktion, Jun. 1999, pp. 1-130.
ASTM International, Designation: E Jan. 1966, Standard Test Method for Fire-Resistive Joint Systems, Current edition approved Oct. 10, 2001, published Jan. 2002, pp. 1- 15.
www.businesswire.com, Celanese Introduces Mowilith Nano Technology Platform for the Next General of Exterior Coatings, May 8, 2007, Nurnberg, Germany, pp. 1- 3.
Dayton Superior Chemical & Cement Products, Marketing Update, Fall 2005, pp. 1-2.
Dow Corning Silicone Sealants, Dow Corning 790 Silicone Building Sealant, Ultra-low-modulus sealant for new and remedial construction joint sealing applications, labeled Copyright 2000-2005, pp. 1-2.
Dow Corning, John D. Farrell Letter to Emseal USA, Wilford Brewer, reference: Emseal Greyflex, Oct. 4, 1984, p. 1.
Emseal Joint Systems, Ltd., Greyflex & Backerseal Wet Sealant Compatibility Chart, Test Data, Sep. 1991, p. 1.
www.emseal.com/products, Horizontal Colorseal by Emseal Expansion Joints and Pre-Compressed Sealants, last modified Sep. 19, 2014.
Emseal Material Safety Data Sheet, Acrylic Loghome Tape, Apr. 2002, pp. 1-2.
Emseal Joint Systems, The complete package for all joint requirements, 1988, pp. 1-6.
web.archive.org, www.envirograf.com, Product 40: Intumescent-Coated Fireproof Sponge (patented), labeled Copyright 2007, pp. 1-2.
web.archive.org, www.envirograf.com, Product 5: Intumescent-Caoted Non-Fibrous Slabs (patented), labeled Copyright Apr. 10, 2007, p. 1.
Hanno Dicht-und Dammsysteme, Hannoband- BG1, High Performance am Bau, German language, 2000, pp. 1-6.
Illbruck Sealant Systems, Cocoband 6069, Productinfomatie, Dutch language, 2003, pp. 1-2.
Illbruck Sealant Systems, Inc., Sealant Products and Systems, 2002, pp. 1-12.
Decision Granting Ex Parte Reexamination on Control No. U.S. Appl. No. 90/013,473, May 19, 2015, 13 pages.
U.S. Appl. No. 60/953,703, filed Aug. 3, 2007 underlying U.S. Pat. No. 8,397,453, 24 pages.
Merritt, Protection against Hazards, Section 3.30-3.31, 1994, pp. 1-4.
Schultz, Fire and Flammability Handbook, p. 363, 1985, pp. 1-3.
Netherlands Standards Institute, Fire resistance tests for non-loadbearing elements—Part 1: Walls, Aug. 1999, NEN-EN 1364-1, pp. 1-32.
Troitzsch, Jurgen, International plastics flammability handbook, 1983, pp. 1-2.
Polytite Manufacturing Company, Polytite "R" Colorized Joint Sealant, Jan. 7, 1998, pp. 1-2.
Saint-Gobain Performance Plastics, Norseal V740, labeled Copyright 2001, pp. 1-2.
Schul International Corporation, Hydrostop, Expansion Joint System, Jan. 17, 2001, pp. 1-2.
Schul International Co., LLC., Sealtite "B" Type II, Part of the S3 Sealant System, Jan. 5, 2006, pp. 1-2.
Schul International Co., LLC., Material Safety Data Sheet, Seismic Sealtite, Revised date Oct. 23, 2002, pp. 1-3.
Sealtite-Willseal, Installation Procedures for Seismic Sealtite/250C Joint Sealant, Mar. 4, 2001, p. 1.
UL Online Certifications Directory, XHBN.GuideInfo, Joint Systems, last updated Sep. 21, 2013, pp. 1-4.
Williams Products, Inc., Williams Everlastic 1715 Fire Classified Closures Tech Data, Oct. 2005, p. 1.
Emseal Joint Systems, Ltd., Emseal Colorseal Tech Data, Jul. 2009, p. 1-2.
Emseal Joint Systems, Ltd., Emseal Colorseal Tech Data, Mar. 2011, p. 1-2.
Emseal Joint Systems, Ltd., Emseal Horizontal Colorseal Tech Data, Aug. 2014, p. 1-2.
Emseal Joint Systems, Ltd., Emseal Seismic Colorseal Tech Data, Oct. 2009, pp. 1-2.
Emseal Joint Systems, Ltd., Emseal Seismic Colorseal Tech Data, Jun. 2010, pp. 1-2.
Emseal Joint Systems, Ltd., Emseal MST, Multi-Use Sealant Tape, Sep. 2008, pp. 1-2.

(56) References Cited

OTHER PUBLICATIONS

Emseal Joint Systems, Ltd., Emseal MST, Multi-Use Sealant Tape, Oct. 2013, pp. 1-2.
Emseal Joint Systems, Ltd., Emshield DFR2 System, Tech Data, Sep. 2014, pp. 1-4.
Emseal Joint Systems, Ltd., Emshield DFR2, last modified Sep. 19, 2014, pp. 1-4.
Emseal Joint Systems, Ltd., Emshield DFR3, last modified Sep. 4, 2014, pp. 1-5.
Emseal Joint Systems, Ltd., Emshield WFR2 and WFR3, last modified Sep. 3, 2014, pp. 1-5.
Emseal Joint Systems, Ltd., Colorseal-on-a-reel, last modified Nov. 10, 2014, pp. 1-3.
Emseal Joint Systems, Ltd., Colorseal, last modified Oct. 9, 2014, pp. 1-3.
Emseal Joint Systems, Ltd., QuietJoint, Tech Data, Nov. 2012, pp. 1-2.
Emseal Corporation Ltd. Material Safety Data Sheet, QuietJoint, MSDS Date May 13, 2014, pp. 1-2.
Emseal Joint Systems, Ltd., QuietJoint CAD Details, last modified Oct. 31, 2014, pp. 1-3.
http://www.emseal.com/products/architectural/QuietJoint/QuietJoint.htm, QuietJoint Mass-Loaded Acoustic Partition Closure, last modified Oct. 9, 2014, pp. 1-4.
http://www.emseal.com/products/architectural/QuietJoint/QuietJoint.htm, QuietJoint Mass-Loaded Acoustic Partition Closure, last modified Jul. 29, 2014, pp. 1-4.
http://www.emseal.com/products/architectural/QuietJoint/QuietJoint.htm, QuietJoint Mass-Loaded Acoustic Partition Closure, No intumescent coating, last modified Sep. 19, 2014, pp. 1-4.
Baerveldt, Konrad, The Applicator—Dear Tom: Emseal has two EIFS Expansion Joint Answers for you, Jun. 1991, pp. 1-4.
DIN 4102-1, Fire Behaviour of Building Materials and Elements, Part 1, May 1998, pp. 1-33.
DIN 4102-2, Fire Behaviour of Building Materials and Building Components, Part 2, Sep. 1977, pp. 1-11.
DIN 4102-15, Fire Behaviour of Building Materials and Elements, Part 15, May 1990, pp. 1- 15.
DIN 18542, Impregnated Cellular Plastics Strips for Sealing External Joints, Jan. 1999, pp. 1-10.
ASTM International, Standard Test Method for Surface Burning Characteristics of Building Materials, Designation: E-84-04, Feb. 2004, pp. 1-19.
Illbruck Bau-Technik GmbH, Illbruck Illmod 600, Jan. 2002, pp. 1-2.
Illbruck Sealant Systems, Inc., Illbruck Willseal 600, 2001, pp. 1-2.
Schul International, Co., LLC., Seismic Sealtite II, Colorized, Pre-compressed Joint Sealant for Vertical Applications, Technical Data, 2006, pp. 1-2.
Underwriters Laboratories, Inc., Standard for Safety, Tests for Fire Resistance of Building Joint Systems, UL-2079, Fourth Edition, Dated Oct. 21, 2004, Revisions through and including Jun. 30, 2008, pp. 1-38.
MM Systems Corp., MM DSS Expansion Joint, Dual Seal Self-Expanding Seismic System, Feb. 18, 2008, pp. 1-2.
Order Granting Request for Ex Parte Reexamination for U.S. Pat. No. 8,739,495, Dec. 12, 2014, Control No. U.S. Appl. No. 90/013,395, pp. 1-19.
Emseal Joint Systems, Ltd., Fire-Rating of Emseal 20H System, Feb. 17, 1993, p. 1.
C:\WP\SLSMTG\20HDBJ.TBL Apr. 18, 1993, 20H—Description, Benefits, Justification, p. 1.
Order Granting Request for Ex Parte Reexamination for U.S. Pat. No. 8,813,449, Feb. 11, 2015, Control No. U.S. Appl. No. 90/013,428, pp. 1-19.
Snapshot of Office Action issued in U.S. Appl. No. 14/540,514; printed in 2015; 21 pages.
List of several Emseal pending patent applications and patents, and Examiners assigned thereto; Apr. 2015; 2 pages.
Notification of Transmittal of International Preliminary Report on Patentability in PCT/US14/32212; Mar. 13, 2015; 4 pages.
Snapshot of Office Actions issued in U.S. Appl. No. 13/729,500; printed in 2015; 35 pages.
Snapshot of Office Actions issued in U.S. Appl. No. 14/278,210; printed in 2015; 27 pages.
Snapshot of Office Actions issued in U.S. Appl. No. 12/635,062; printed in 2015; 88 pages.
Snapshot of Office Actions issued in U.S. Appl. No. 13/731,327; printed in 2015; 42 pages.
Snapshot of Office Action issued in U.S. Appl. No. 14/455,398; printed in 2015; 9 pages.
Snapshot of Office Actions issued in U.S. Appl. No. 13/652,021; printed in 2015; 34 pages.
Snapshot of Office Actions issued in U.S. Appl. No. 14/080,960; printed in 2015; 10 pages.
Snapshot of Office Actions issued in U.S. Appl. No. 14/084,930; printed in 2015; 7 pages.
Snapshot of Office Action issued in U.S. Appl. No. 14/229,463; printed in 2015; 20 pages.
Snapshot of Office Action issued in U.S. Appl. No. 14/455,403; printed in 2015; 12 pages.
Snapshot of Office Action issued in U.S. Appl. No. 14/211,694; printed in 2015; 6 pages.
Watson Bowman Acme, Wabo Seismic Parking Deck Exp. Joints, Sales Drawing, Feb. 6, 1988, 3 pgs.
Emseal Corp., Horizontal Colorseal Data Sheet, Jun. 1997, 3 pgs.
Emseal Corp., Horizontal Colorseal Beneath Coverplate Product Design Drawing, Oct. 2000, 1 pg.
Emseal Corp., 20H System Data Sheet, Sep. 1996, pp. 1-2.
Watson Bowman Acme, Product Catalog, Feb. 1993, pp. 1-8.
Emseal Joint Systems, Watertight by Design, Buyline 0339, Copyrighted 1996 and marked Jan. 1999, 8 pgs.
Dow Corning, Down Corning 790 Silicone Building Sealant Data Sheet, Copyrighted 1995, 1999, 8 pgs.
Emseal Joint Systems, Sealing Joints in the Building Envelope: Principles, Products & Practices, Copyright date of 1999, 39 pgs.
Emseal Joint Systems, Product Catalog, Copyright date of 1987, 16 pgs.
Emseal Joint Systems, 20H-Compression Seal Comparison, Apr. 12, 1994, 1 pg.
Emseal Joint Systems, LTD., Emseal Joint Systems, Marketing Brochure, Jan. 1997, 8 pgs.
City of San Diego, CWP Guidelines, Feb. 1992, pp. 1-13.
www.stifirestop.com, Specified Technologies, Inc., Product Data Sheet, Series ES Elastomeric Sealant, Copyright 2004, pp. 1-4.
www.stifirestop.com, Specified Technologies, Inc., Product Data Sheet, Pensil PEN300 Silicone Sealant, Copyright 2004, pp. 1-4.
Snapshot of Office Action issued in U.S. Appl. No. 14/540,514; printed in 2015, 22 pages.
Snapshot of Office Action issued in U.S. Appl. No. 90/013,395; printed in 2015, 27 pages.
Report on the Filing or Determination of an Action Regarding a Patent or Trademark, Docket No. 1:14-cv 358-SM, Filed Aug. 13, 2014 regarding U.S. Pat. No. 8,739,495, 1 pg.
Report on the Filing or Determination of an Action Regarding a Patent or Trademark, Docket No. 14-cv-359-PB, Filed Aug. 13, 2014 regarding U.S. Pat. No. 8,739,495, 1 pg.
Defendants' Answer, Counterclaims, Affirmative Defenses, and Jury Demand, 1:14-cv-00359-PB, Doc. 11, Filed Oct. 3, 2014, 20 pages.
Defendants' Objection to Plaintiffs Partial Motion to Dismiss, 1:14-cv-00358-SM, Doc. 24, Filed Nov. 10, 2014 pp. 1-3.
Defendants' Objection to Plaintiffs Motion to Strike Defendants' Tenth Affirmative Defense, 1:14-cv-00358-SM, Doc. 25, Filed Nov. 12, 2014, pp. 1-3.
Defendants' Answer, Counterclaims, and Affirmative Defenses to Plaintiffs Consolidated Complaint, 1:14-cv-00358-SM, Doc. 38, Filed Dec. 9, 2014, pp. 1-48.
Defendants' Objection to Plaintiffs Partial Motion to Dismiss Count III of Defendants' Counterclaim, 1:14-cv-00358-SM, Doc. 50, Filed Jan. 16, 2015, pp. 1-15.

(56) References Cited

OTHER PUBLICATIONS

Defendants' Surreply to Plaintiffs Partial Motion to Dismiss Count II of Defendants' Counterclaims., 1:14-cv-00358-SM, Doc. 55, Filed Feb. 13, 2015, pp. 1-6.
Joint Claim Construction and Prehearing Statement, 1:14-cv-00358-SM, Doc. 56, Filed Mar. 3, 2015, pp. 1-9.
Lester Hensley, "Where's the Beef in Joint Sealants? Hybrids Hold the Key," AWCI's Construction Dimensions, , Jan. 2006, 3 pgs.
IsoChemie, Iso-Bloco 600, Correspondence of Jun. 8, 2006, 13 pages.
Shul International Company, Invoice #18925 to P. J. Spillane, Sep. 14, 2007, 5 pages.
Illbruck Inc., Tested Physical Properties, 1994, 1 page.
Andrea Frangi, Zum Brandverhalten von Holzdecken aus Hohlkasten-elementen; Jun. 1999; 125 pages (English Translation).
Defendants' Joint First Amended Preliminary Invalidity Contentions received at MKG Mar. 17, 2015, 1:14-cv-00358-SM, 25 pgs. total.
Defendants' Joint First Amended Preliminary Invalidity Contentions received at MKG Mar. 17, 2015, Appendix A, 6 pgs.
Defendants' Joint First Amended Preliminary Invalidity Contentions received at MKG Mar. 17, 2015, Appendix B, 270 pgs.
Defendants' Joint First Amended Preliminary Invalidity Contentions received at MKG Mar. 17, 2015, Appendix B, 376 pgs.
Defendants' Joint First Amended Preliminary Invalidity Contentions received at MKG Mar. 17, 2015, Appendix C, 125 pgs.
Defendants' Joint First Amended Preliminary Invalidity Contentions received at MKG Mar. 17, 2015, Appendix D, 4 pgs.
IBMB, Test Report No. 3263/5362, Jul. 18, 2002, English Translation, 14 pgs.
IBMB, Test Report No. 3263/5362, Jul. 18, 2002, German, 13 pgs.
IBMB, Test Certificate No. 3002/2719, Mar. 22, 2000, English Translation, 14 pgs.
IBMB, Test Certificate No. P-3568/2560-MPA BS, Sep. 30, 2000, English Translation, 22 pgs.
IBMB, Test Certificate No. P-3568/2560-MPA BS, Sep. 30, 2000, German, 14 pgs.
IFT Rosenheim, Evidence of Performance Test Report 105 324691/e U, Apr. 19, 2006, 8 pgs.
Snapshot of Office Action issued in U.S. Appl. No. 90/013,428; printed in 2015, 14 pages.
Snapshot of Notice of Allowance issued in U.S. Appl. No. 14/080,960; printed in 2015, 5 pages.
MM Systems Corporation, MM LMS Expansion Joint, Spec Data "LokCrete Membrane Sealing System", Nov. 13, 2012; 2 pages.
Emseal Thermaflex Tech Data, "Watertight Parking-Deck and Stadium Expansion Joint Systems", current data sheet Nov. 2014, pp. 1-4.
Emseal Joint Systems, Lt., Preformed Sealants and Expansion Joint Systems, May 2002, pp. 1-4.
Emseal Joint System, Ltd., Tech Data DSH System, Jan. 2000, pp. 1-2.
Emseal Joint Systems, Ltd., Emseal CAD.dwg, Oct. 2000, 7 pages.
Emseal Joint Systems, Ltd., Installation Instructions: AST & IST Sealant Tapes, Dec. 1998, p. 1.
Emseal Joint Systems, Ltd., Emshield WFR2, Fire-Rated Expansion Joint Product Data, Jun. 2009, pp. 1-2.
Emseal Joint System, Ltd., 1/2 Inch Colorseal, Binary Seal System Components, document dated Nov. 24, 1992, p. 1.
Schul International Co., LLC., Firejoint 2FR-H, Fire Rated Expansion Joint 2 Hour Fire Rated, labeled Copyright 2012, pp. 1-2.
Willseal LLC, Product Data Sheet, Willseal FR-H, Horizontal 2 and 3 hour fire rated seal, labeled Copyright 2013, pp. 1-2.
Schul International Co., LLC., Firejoint 2FR-V, Fire Rated Expansion Joint- 2 Hour Fire Rated, labeled Copyright 2012, pp. 1-2.
Willseal LLC, Product Data Sheet, Willseal FR-V, Vertical 2 and 3 hour fire rated seal, labeled Copyright 2013, pp. 1-2.
UL Online Certifications Directory, System No. FF-D-0082, XHBN.FF-D-0082 Joint Systems, Jul. 29, 2013, pp. 1-2.
UL Online Certifications Directory, System No. FF-D-1100, XHBN.FF-D-1100 Joint Systems, Sep. 24, 2012, pp. 1-2.
UL Online Certifications Directory, System No. WW-D-2013, XHBN.WW-D-2013 Joint Systems, May 27, 2004, pp. 1-2.
UL Online Certifications Directory, System No. FF-D-2008, XHBN.FF-D-2008 Joint Systems, Mar. 31, 2003, pp. 1-2.
UL Online Certifications Directory, System No. FF-D-1053, XHBN.FF-D-1053 Joint Systems, Nov. 28, 2007, pp. 1-2.
UL Online Certifications Directory, System No. WW-D-3005, XHBN.VVW-D-3005 Joint Systems, Nov. 15, 1999, pp. 1-2.
UL Online Certificates Directory, XHHW.R8196 Fill, Void or Cavity Materials, labeled Copyright 2014, pp. 1.
UL Online Certifications Directory, XHBN.FF-D-0075 Joint Systems, Apr. 30, 2010, pp. 1-2.
UL Online Certifications Directory, System No. FF-D-0075, XHBN.FF-D-0075 Joint Systems, Aug. 21, 2014, pp. 1-2.
UL Online Certifications Directory, XHBN.FF-D-0094 Joint Systems, Sep. 11, 2013, pp. 1-2.
UL Online Certifications Directory, XHBN.FF-D-1121 Joint Systems, Apr. 25, 2013, pp. 1-2.
UL Online Certifications Directory, System No. FF-D-2006, XHBN.FF-D-2006 Joint Systems, Jun. 28, 2002, pp. 1-3.
Underwriters Laboratories (UK) Ltd., Assessment Report, Project No. 12CA37234, Aug. 24, 2012, pp. 1-20.
Emseal Joint Systems, Ltd., 2 inch Quietjoint—concrete to concrete, Part No. SHH_2_WW_CONC, Mar. 25, 2014, p. 1.
Emseal Joint Systems, Ltd., 2 inch Quietjoint—gypsum to gypsum, Part No. SHH_2_WW_GYP, Mar. 25, 2014, p. 1.
Emseal Joint Systems, Ltd., 2 inch Quietjoint at concrete wall to window, Part No. SHG_2_WW_CONC_TO_GLASS_INSIDE_CORNER, Mar. 25, 2014, p. 1.
Emseal Joint Systems, Ltd., 2 inch Quietjoint at Gypsum Wall to Window, Part No. SHG_2_WW_GL_INSIDE_CORNER_GYP, Mar. 25, 2014, p. 1.
Emseal Joint Systems, Ltd., 2 inch Quietjoint—Concrete to Concrete at Head of Wall, Part No. SHH_2_HW_CONC_INSIDE_CORNER, Mar. 25, 2014, p. 1.
Emseal Joint Systems, Ltd., 2 inch Quietjoint—Gypsum to Concrete at Head of Wall, Part No. SHH_HW_GYP_CONC_INSIDE_CORNER, Mar. 25, 2014, p. 1.
Emseal Joint Systems, Ltd., 2 inch Quietjoint at Wall Partition to Window, Part No. SHG_2_WW_GL_INSIDE_CORNER_WALL_PARTITION_WINDOW, Mar. 25, 2014, p. 1.
Emseal Joint Systems, Ltd., Emshield DFR3 MSDS, last modified Sep. 3, 2014, p. 1.
https://www.google.com/search, seismic colorseal 5130176 "5,130,176", printed on Oct. 12, 2014, p. 1.
http://www.amazon.com, search for emseal U.S. Pat. No. 8,739,495, 1-16 of 624 results for emseal U.S. Pat. No. 8,739,495, printed on Oct. 13, 2014, pp. 1-5.
http://www.amazon.com/QuietJoint-Acoustic-Partition-Closure-2-sided, QuietJoint Acoustic Partition Closure for 3 inch (75mm) Joint, 10 foot (3m), printed on Sep. 29, 2014, pp. 1-3.
http://www.amazon.com/QuietJoint-Acoustic-Partition-Closure-3-sided, QuietJoint Acoustic Partition Closure for 5/8 inch (15 mm) Joint, 10 foot (3m), printed on Oct. 13, 2014, pp. 1-3.
Illbruck, Illmod 2d, Product Information, 2002, pp. 1-2.
Emseal Joint Systems, Ltd., Laminations as a Build Choice—The Anatomy of Quality in Pre-Compressed Foam Sealants, last modified Jul. 30, 2013, pp. 1-3.
Dow Coming 890 Self-Leveling Silicone Joint Sealant; Dow Coming Corporation; 1996, 1999.
Snapshot of Notice of Intent to Issue Ex Patent Reexamination Certificate for 90/013,472; Feb. 19, 2016, 8 pages.
Snapshot of Final Office Action for 90/013,511; Feb. 26, 2016, 45 pages.
Defendants' Joint Second Amended Preliminary Invalidity Contentions received at MKG Jun. 30, 2015, Appendix A, 7 pgs.
Defendants' Joint Second Amended Preliminary Invalidity Contentions received at MKG Jun. 30, 2015, Appendix B-1, 346 pgs.
Defendants' Joint Second Amended Preliminary Invalidity Contentions received at MKG Jun. 30, 2015, Appendix B-2, 314 pgs.

(56) References Cited

OTHER PUBLICATIONS

Defendants' Joint Second Amended Preliminary Invalidity Contentions received at MKG Jun. 30, 2015, Appendix C, 159 pgs.
Defendants' Joint Second Amended Preliminary Invalidity Contentions received at MKG Jun. 30, 2015, Appendix D, 5 pgs.
Defendants' Joint Second Amended Preliminary Invalidity Contentions received at MKG Jun. 30, 2015, 1:14-cv-00358-SM, 27 pgs. total.
Snapshot of Notice of Allowance for U.S. Appl. No. 12/635,062; Oct. 9, 2015, 5 pages.
Snapshot of Office Action for 90/013,511; Oct. 23, 2015, 28 pages.
Snapshot of Final Office Action for 90/013,473; Nov. 6, 2015, 38 pages.
ACI 504-R, Guide to Sealing Joint in Concrete Structures, ACI Committee 504, 1997, 44 pages.
Snapshot of Office Action issued in U.S. Appl. No. 13/652,021; printed in 2015, 13 pages.
Snapshot of Office Action issued in U.S. Appl. No. 90/013,511; printed in 2015, 24 pages.
Snapshot of Office Action issued in U.S. Appl. No. 14/278,210; printed in 2015, 11 pages.
Snapshot of Decision Granting Ex-Parte Reexamination issued in U.S. Appl. No. 90/013,472; printed in 2015; 25 pages.
Snapshot of Notice of Allowance issued in U.S. Appl. No. 14/229,463; printed in 2015; 8 pages.
Snapshot of Notice of Allowance issued in U.S. Appl. No. 13/731,327; printed in 2015, 8 pages.
Snapshot of Advisory Action for 90/013,472-90/013,473; Dec. 28, 2015,13 pages.
Snapshot of Non-Final Office Action for 90/013,428; Jan. 5, 2016, 14 pages.
Snapshot of Non-Final Office Action for 90/013,565; Jan. 8, 2016, 20 pages.
Emseal, BEJS System—Bridge Expansion Joint System, May 26, 2010, 5 pages.
Emseal, Emseal Acrylic Log Home Tape Installation Instructions, Jun. 2011, 1 page.
Snapshot of Notice of Allowance for U.S. Appl. No. 13/652,021; Jan. 8, 2016, 7 pages.
Snapshot of Non-Final Office Action for U.S. Appl. No. 14/084,930; Jan. 12, 2016, 11 pages.
Snapshot of Office Action in Ex Parte Reexamination for 90/013,395; Jan. 20, 2016, 26 pages.
2000 Fire Resistance Directory, p. 1012; publication date unknown from document.
Firestop Submittal Package, Fire Resistive Joint Systems—Waterproofing, SpecSeal Firestop Products, Specified Technologies, Inc, Somerville NJ; p. 1-37, publication date unknown from document.
Specified Technologies Inc., Product Data Sheet, Series ES, Elastomeric Sealant, Copyright 2000, p. 1-4.
Specified Technologies Inc., Product Data Sheet, PEN200 Silicone Foam, Copyright 2003, p. 1-2.
ISO-Chemie GmbH, Schul International Co., Order Confirmation, Doc. No. 135652, Customer No. 38012, Date, Apr. 26, 2007, p. 1-3.
DIN 4102-16, Fire Behaviour of Building Materials and Elements, Part 16, May 1998, pp. 1-12.
Snapshot of Office Action issued in U.S. Appl. No. 90/013,395; printed in 2015, 48 pages.
Snapshot of Office Action issued in U.S. Appl. No. 90/013,428; printed in 2015, 23 pages.
Snapshot of Office Action issued in U.S. Appl. No. 90/013,472; printed in 2015, 22 pages.
Snapshot of Office Action issued in U.S. Appl. No. 90/013,473; printed in 2015, 22 pages.
3M; Fire Barrier CP 25WB+Caulk, Product Data Sheet, Copyright 3M 2001, 4 pages.
Tremco Incorporated, "Firestop Submittal" Data Sheet collections, Certificate of Conformance dated Nov. 2004, 47 pages; publication date unknown from document.
Decision Granting Ex Parte Reexamination on Control 90/013,565; Sep. 29, 2015, 19 pages.
Snapshot of Non-Final Office Action for U.S. Appl. No. 13/731,327; Mar. 18, 2016, 27 pages.
Snapshot of Final Office Action for U.S. Appl. No. 14/455,398; Mar. 29, 2016, 12 pages.
Snapshot of Ex Parte Reexamination Certificate U.S. Pat. No. 6,532,708C1 for 90/013,472; Mar. 23, 2016, 3 pages.
Snapshot of Final Office Action for U.S. Appl. No. 14/540,514; Mar. 31, 2016, 18 pages.
Emseal Corporation, Seismic Colorseal by Emseal, "Last Modified": Aug. 21, 2007, 4 pages.
Emseal Joint Systems, Ltd., Backerseal (Greyllex), Sep. 2001, 2 pages.
Emseal Joint Systems, Ltd., Install Data—Horizontal Colorseal—With Expoxy Adhesive, Jun. 2006, 2 pages.
Snapshot of Office Action for 90/013,395; Apr. 7, 2016, 37 pages.
Snapshot of Office Action for 90/013,565; Apr. 8, 2016, 48 pages.
Emseal Joint Systems, Ltd., BEJS System Tech Data, Mar. 2009, 2 pages.
Emseal's new Universal-90 expansion joints, Buildingtalk, Pro-Talk Ltd., Mar. 27, 2009, 2 pages.
Emseal Joint Systems, Ltd., Emseal Emshield DFR2 System DFR3 System Tech Data, May 2010, 4 pages.
Emseal Seismic Colorseal, Aug. 21, 2007, 4 pages.
Emseal Joint Systems, Ltd., Emseal New Universal 90's Watertight, Factory Fabricated Upturn/Downturn Transition Pieces for Ensuring Continuity of Seal, Aug. 4, 2009, 4 pages.
Snapshot of Office Action for 90/013,428; May 6, 2016, 22 pages.
Snapshot of Office Action for U.S. Appl. No. 14/950,923; May 6, 2016, 13 pages.
Snapshot of Office Action for U.S. Appl. No. 14/730,896; May 9, 2016, 18 pages.
Snapshot of Office Action for U.S. Appl. No. 14/229,463; May 12, 2016, 14 pages.
Snapshot of Advisory Action for U.S. Appl. No. 90/013,511; May 9, 2016, 12 pages.
Snapshot of Ex Parte Reexamination Certificate No. U.S. Pat. No. 6,532,708C2 for 90/013,683; Jun. 7, 2016, 2 pages.
Snapshot of Office Action for U.S. Appl. No. 14/278,210; May 19, 2016, 12 pages.
Snapshot of Office Action for U.S. Appl. No. 14/511,394; May 13, 2016, 6 pages.
Snapshot of Advisory Action for 90/013,395; May 20, 2016, 4 pages.
Snapshot of Advisory Action for 90/013,565; Jul. 19, 2016, 5 pages.
Mercury et al., "On the Decomposition of Synthetic Gibbsite Studied by Neutron Thermodiffractometry", J. Am. Ceram, Soc. 89, (2006), pp. 3728-3733.
Brydon et al., "The Nature of Aluminum Hydroxide-Montmorillonite Complexes", The American Mineralogist, vol. 51, May-Jun. 1966, pp. 875-889.
Huber, Alumina Trihydrate (ATH), A Versatile Pigment for Coatings, Inks, Adhesives, Caulks and Sealants Applications, Dec. 2005, 5 pgs.
3.3.3.8 Thermal Stability/Loss on Ignition/Endotheric Heat, Figure 19, 1 pg.
Snapshot of Examiner's Interview Summary for 90/013,511; Aug. 26, 2016, 9 pages.
Snapshot of Advisory Action for 90/013,428; Sep. 8, 2016, 13 pages.
Snapshot of Advisory Action for 90/013,395; Sep. 14, 2016, 16 pages.
Snapshot of Intent to Issue Ex Parte Reexamination Certificate for 90/013,511; Sep. 21, 2016, 9 pages.
Snapshot of Intent to Issue Ex Parte Reexamination Certificate for 90/013,395; Oct. 6, 2016, 9 pages.
Snapshot of Intent to Issue Ex Parte Reexamination Certificate for 90/013,565; Oct. 7, 2016, 9 pages.
Snapshot of Intent to Issue Ex Parte Reexamination Certificate for 90/013,428; Oct. 31, 2016, 7 pages.
Snapshot of Ex Parte Reexamination Certificate for 90/013,511; Oct. 31, 2016, 3 pages.

(56) References Cited

OTHER PUBLICATIONS

Snapshot of Ex Parte Reexamination Certificate for 90/013,565; Nov. 2, 2016, 3 pages.
Snapshot of Ex Parte Reexamination Certificate for 90/013,428; Nov. 23, 2016, 3 pages.
Snapshot of Notice of Allowance for U.S. Appl. No. 14/540,514; Nov. 25, 2016, 4 pages.
Snapshot of Office Action for U.S. Appl. No. 14/278,210; Nov. 30, 2016, 12 pages.
Snapshot of Office Action for U.S. Appl. No. 13/731,327; Jan. 4, 2017, 6 pages.
Snapshot of Notice of Allowance for U.S. Appl. No. 14/229,463; Jan. 5, 2017, 7 pages.
Snapshot of Notice of Allowance for U.S. Appl. No. 13/731,327; Feb. 10, 2017, 6 pages.

FIG. 16
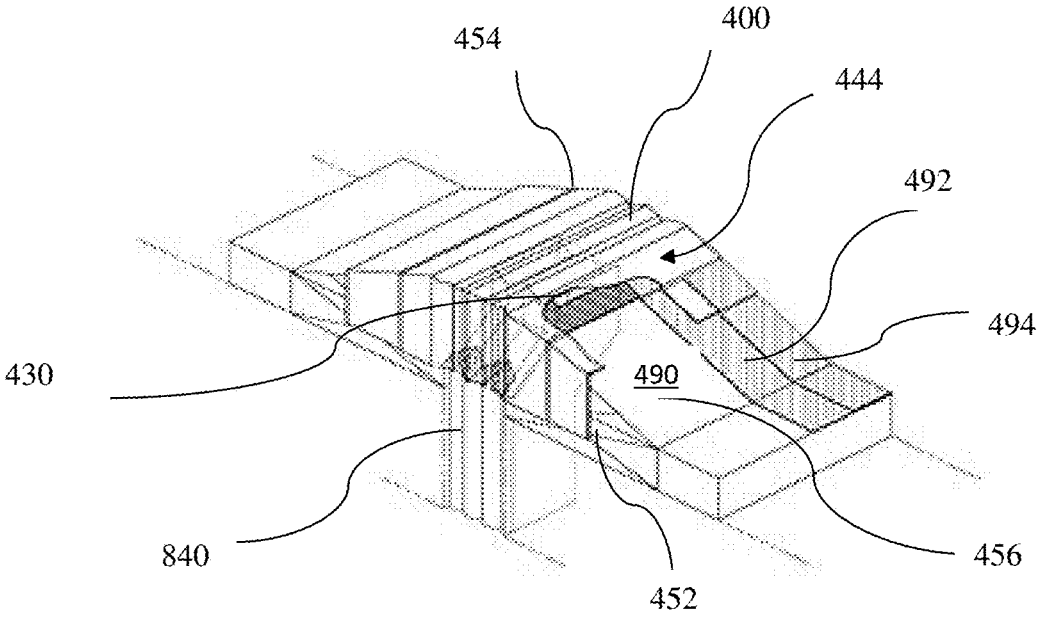
FIG. 16A
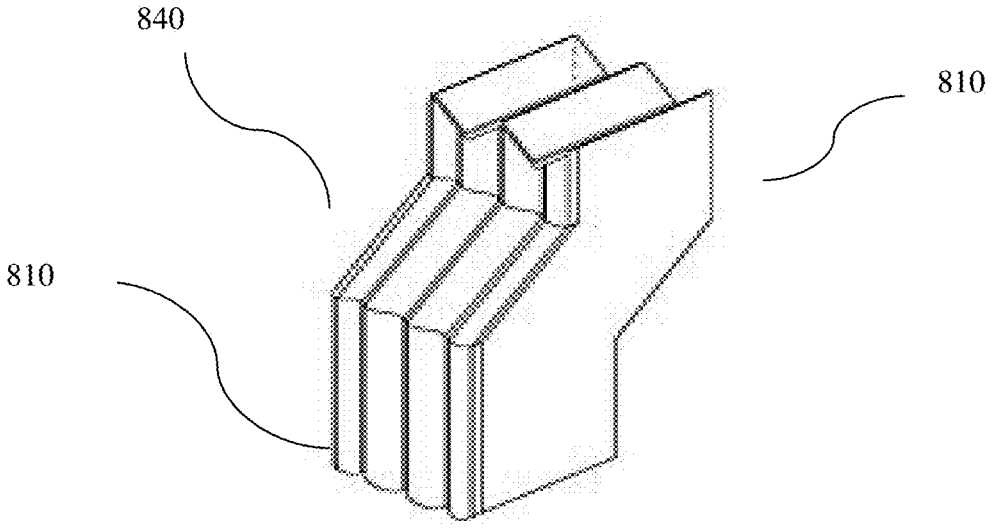
FIG. 16B

FIG. 17
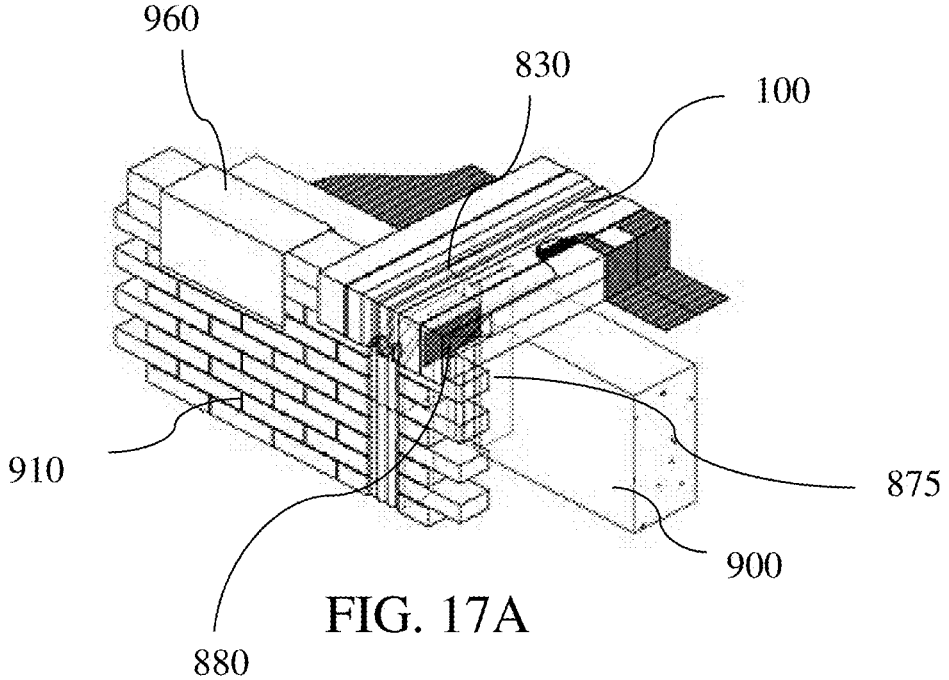
FIG. 17A
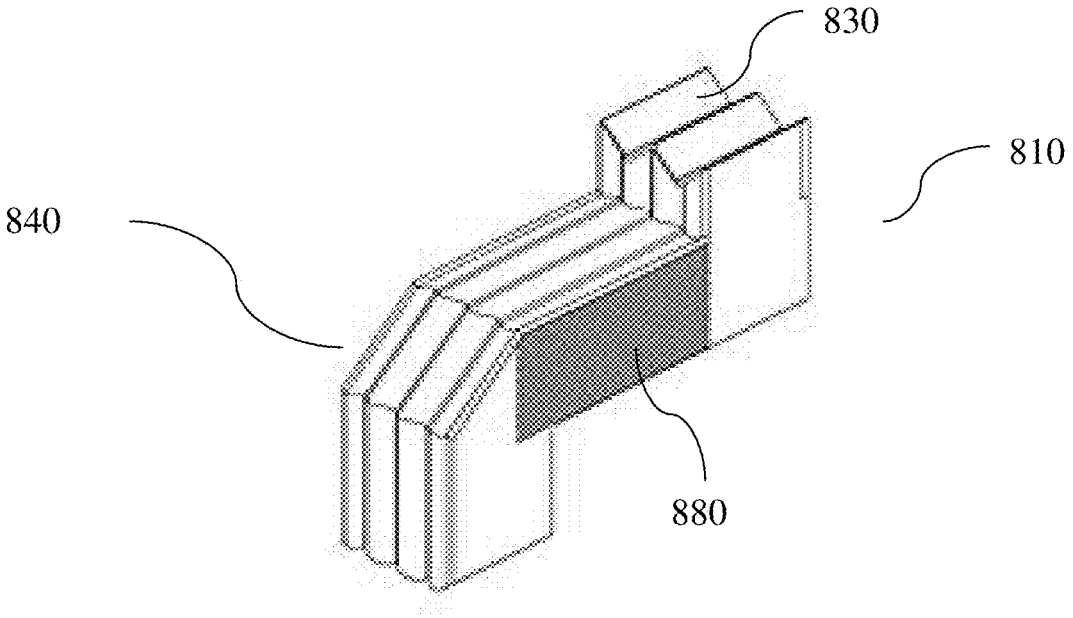
FIG. 17B

FLEXIBLE EXPANSION JOINT SEAL SYSTEM

CROSS-REFERENCE TO RELATED APPLICATIONS

The present application claims the benefit of U.S. Provisional Patent Application Ser. No. 61/788,866, filed Mar. 15, 2013 and is a Continuation-in-Part Application of U.S. Non-Provisional patent application Ser. No. 13/652,021 filed Oct. 15, 2012, now U.S. Pat. No. 9,322,163, which claims the benefit of U.S. Provisional Patent Application Ser. No. 61/547,476, filed Oct. 14, 2011, entitled "THERMOPLASTIC EXPANSION JOINT SEAL FOR ROOFS," the contents of all of the foregoing applications are hereby incorporated by reference in their entireties.

FIELD OF THE INVENTION

The present invention is generally directed to joint sealing systems, and more particularly, to systems for sealing structural expansion joint openings in roofs of structures.

BACKGROUND OF THE INVENTION

In many construction projects involving materials such as concrete and steel, gaps are left between adjacent structural elements to allow for thermal expansion and contraction, wind sway, settlement, live load deflection, and/or seismic movements of the structural elements. By permitting expansion and contraction, the gaps prevent the structural materials and/or building cladding elements from cracking or buckling. These gaps are referred to as expansion joints or movement joints and are typically sealed to prevent them from allowing the passage of water, dirt, debris, or snow, etc. into the structure and/or between portions of the structure.

Current systems for sealing exterior expansion joints in the roofs of structures typically consist of a length of flexible material or membrane that spans a length and width of the joint between adjacent elements and is attached to each side of the joint by anchor bars that are screwed or bolted to the substrate. The membrane, usually a sheet of rubber or the like, is wider than the joint itself to seal the joint and to allow for movement of the structural materials with the joint. Two designs have been developed to address the issue of debris collecting on top of the membrane and straining the seal. FIG. 1 shows a prior art example of a roof expansion joint seal 10 manufactured by Johns Manville (Denver, Colo. USA). In this design, a membrane 12 is humped up above a joint J by a foam backing 14 to seal S the joint J. FIG. 2 shows a prior art example of a roof expansion joint seal 20 manufactured by MM Systems Corporation (Pendergrass, Ga. USA). This design includes a metal cover 24 over a membrane 22, which is allowed to hang into the joint J to form the seal S. As shown in FIG. 1, the roof expansion joint seal 10 is affixed about the joint J by one or more fasteners 16 through a flange 18 of the roof expansion joint seal 10. Similarly, as shown in FIG. 2, the roof expansion joint seal 20 is affixed about the joint J by fasteners 26 through a lip or flange 28 of the roof joint seal 20.

Problems may arise with either joint seal 10 and 20 in several areas. For example, the fasteners 16 and 26 are exposed to weather conditions and the seals may fail as they deteriorate and no longer effectively anchor the seals 10 and 20 about the joint J. Additionally, the seals 10 and 20 provide only a single layer of waterproofing, increasing the chances of failure of the seals. Finally, the shape of the membrane 12 and 22, whether hanging down or humped up, makes it difficult to transition from a horizontal roof expansion joint to a vertical wall expansion joint without compromising the continuity of the seals or undertaking significant modifications to the seals 10 and 20 in the field.

SUMMARY OF THE INVENTION

According to aspects illustrated herein, there is provided a watertight, integrated wall and roof expansion joint seal system comprising an expansion joint seal for a structure. The expansion joint seal comprises a central portion having an underside and at least one central chamber disposed around a centerline. The central portion is disposed within and fills a gap between a first substrate and a second substrate of a structure of interest such a roof. The expansion joint seal has a first flange portion extending outwardly from the centerline and a second flange portion extending outwardly from the centerline in a direction opposite the first flange portion. The expansion joint seal also comprises a fold comprising a first fold portion and a second fold portion. The first fold portion of the first flange portion is attachable to a first surface of the first substrate and the second fold portion of the first flange portion is attachable to a second surface of the first substrate. The first fold portion of the second flange portion is attachable to a first surface of the second substrate and the second fold portion of the second flange portion is attachable to a second surface of the second substrate. The watertight integrated wall and roof expansion joint seal system also comprises a joint closure comprising a core and a layer of elastomer disposed on the core. The joint closure also comprises an end portion configured to match and integrate with the underside of the central portion to form the watertight, integrated wall and roof expansion joint system, wherein movement of one or both of the first or second substrates causes a response in the central portion to maintain the seal. In one embodiment, at least one of the first flange portion and the second flange portion is comprised of a flexible material such that the at least one of the first flange portion and the second flange portion may be affixed to the structure at an angle or an elevation that differs from the central portion. In one embodiment, at least one of the first flange portion and the second flange portion is bifurcated into an upper flange portion and a lower flange portion. The upper flange portion extends further in length from the centerline than the lower flange portion to facilitate interlaying the expansion joint seal with roofing materials to form a water tight seal of the structure.

According to embodiments, the expansion joint seal system further comprises a watertight barrier located beneath the central portion and between the first substrate and the second substrate forming a watertight seal between the first substrate and the second substrate. Movement of one or more of the first substrate and the second substrate causes a response in the central portion and in the watertight barrier to maintain the seal. According to further embodiments, the expansion joint seal system comprises an insulation batt and a looped membrane of roofing material located beneath the central portion and between the first substrate and the second substrate forming an insulating seal between the first substrate and the second substrate, wherein movement of one or more of the first substrate and the second substrate causes a response in the central portion to maintain the seal.

According to further aspects illustrated herein, there is provided a garden roof assembly. The garden roof assembly comprises an expansion joint seal for a structure, comprising a central portion having at least one central chamber disposed around a centerline; a first flange portion extending outwardly from the centerline; and a second flange portion extending outwardly from the centerline in a direction opposite the first flange portion. The expansion joint seal also comprises a fold comprising a first fold portion and a second fold portion. The first fold portion of the first flange portion is attachable to a first surface of the first substrate and the second fold portion of the first flange portion is attachable to a second surface of the first substrate. The first fold portion of the second flange portion is attachable to a first surface of the second substrate and the second fold portion of the second flange portion is attachable to a second surface of the second substrate, the expansion joint seal being configured for a roof. The garden roof assembly further comprises at least one layer of roofing material located over the expansion joint seal and comprising a growing medium, thereby forming the garden roof assembly.

According to further aspects illustrated herein, there is provided an expansion joint seal system comprising an expansion joint seal for a structure. The seal comprises a central portion having at least one central chamber disposed around a centerline; a first flange portion extending outwardly from the centerline; and a second flange portion extending outwardly from the centerline in a direction opposite the first flange portion. When installed on the structure the first flange portion is attachable to a first substrate of the structure and the second flange portion is attachable to a second substrate of the structure such that the central portion is disposed within and seals a gap formed between the first substrate and the second substrate of the structure; wherein movement of one or both of the first substrate and the second substrate causes a response in the central portion to maintain the seal. The expansion joint seal system further comprises at least one of i) a watertight barrier located beneath the central portion and between the first substrate and the second substrate forming a watertight seal between the first substrate and the second substrate, and ii) an insulation batt and a looped membrane of roofing material located beneath the central portion and between the first substrate and the second substrate forming an insulating seal between the first substrate and the second substrate.

According to further aspects illustrated herein, there is provided a garden roof assembly comprising an expansion joint seal for a structure. The expansion joint seal comprises a central portion having at least one central chamber disposed around a centerline; a first flange a first flange portion extending outwardly from the centerline; and a second flange portion extending outwardly from the centerline in a direction opposite the first flange portion. When installed on the structure the first flange portion is attachable to a first substrate of the structure and the second flange portion is attachable to a second substrate of the structure such that the central portion is disposed within and seals a gap formed between the first substrate and the second substrate of the structure. Movement of one or both of the first substrate and the second substrate causes a response in the central portion to maintain the seal. The garden roof assembly further comprises at least one layer of roofing material located over the expansion joint seal and comprising a growing medium, thereby forming the garden roof assembly.

BRIEF DESCRIPTION OF THE DRAWINGS

FIG. 16 is a perspective view of the expansion joint seal system of FIG. 11 as installed in a solid to wall roof closure application (shown in FIG. 16A) and employing a joint closure configured as a solid to wall transition piece (shown in FIG. 16B);

FIG. 17 is a perspective view of the expansion joint seal system of FIG. 11 as installed in a cavity to wall roof closure application (shown in FIG. 17A) and employing a joint closure configured as a cavity to wall transition piece (shown in FIG. 17B);

DETAILED DESCRIPTION OF PREFERRED EMBODIMENTS

The present invention alleviates perceived problems associated with current rooftop expansion joint systems by including, for example, redundant levels of waterproofing, a dual flange apparatus, which protects the anchors and enhances the seal, and the ability to manufacture transitions that can be integrated into coplanar, perpendicular and other expansion joints.

Figure 1:
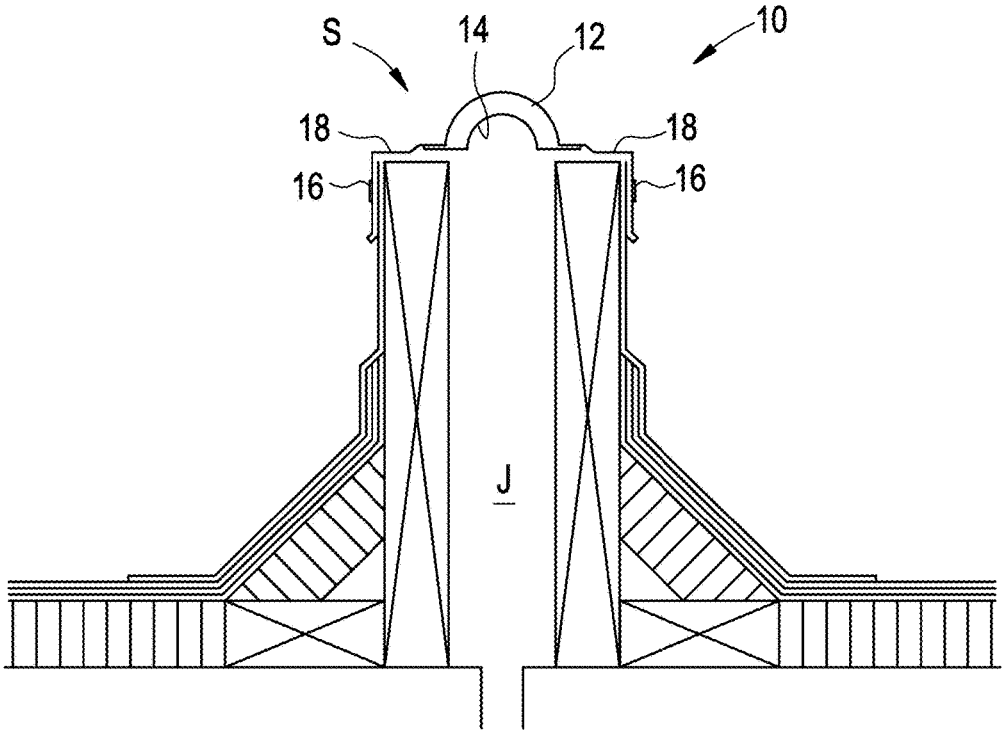
FIG. 1 PRIOR ART
FIG. 1 is a cross-sectional view of a prior art roof expansion joint seal.
Figure 2:
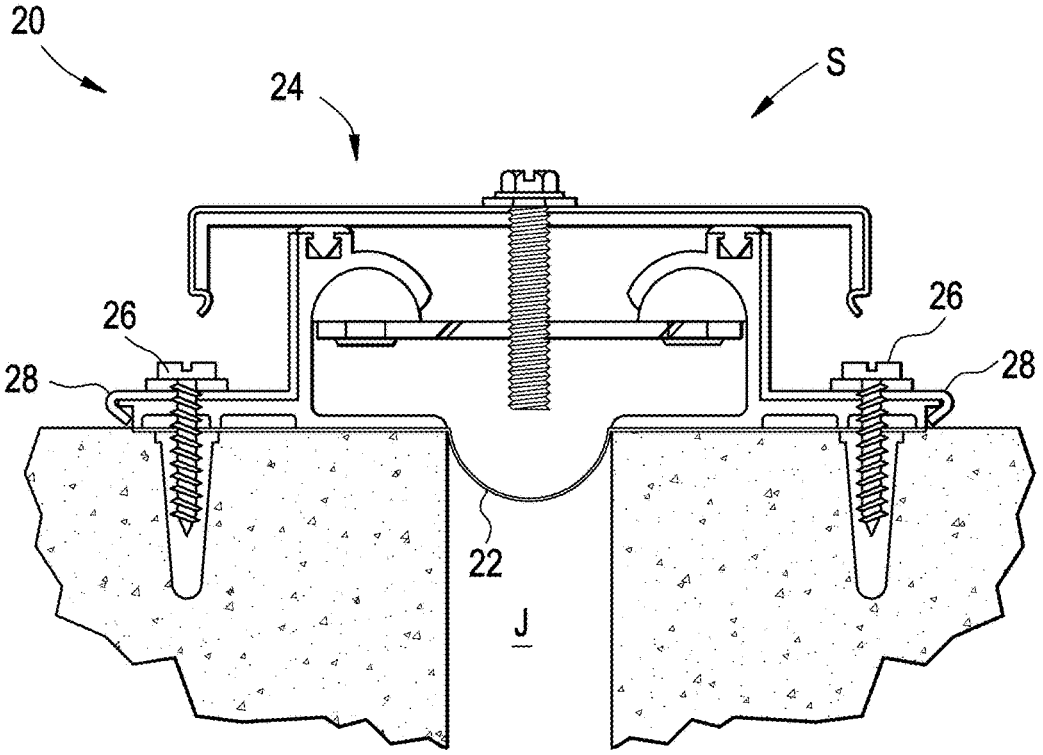
FIG. 2 PRIOR ART
FIG. 2 is a cross-sectional view of a prior art roof expansion joint seal.
Figure 3:
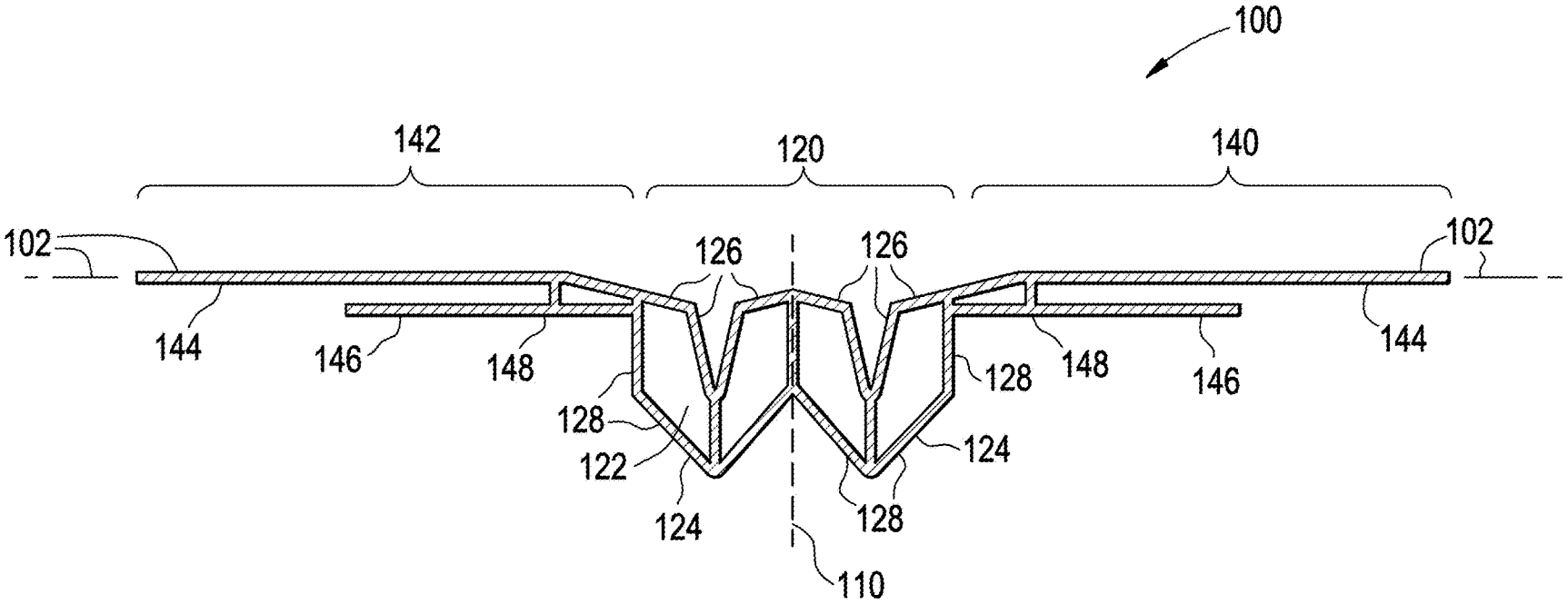
FIG. 3 is an end view of an expansion joint seal in accordance with one embodiment of the present invention before installation.
Figure 4:
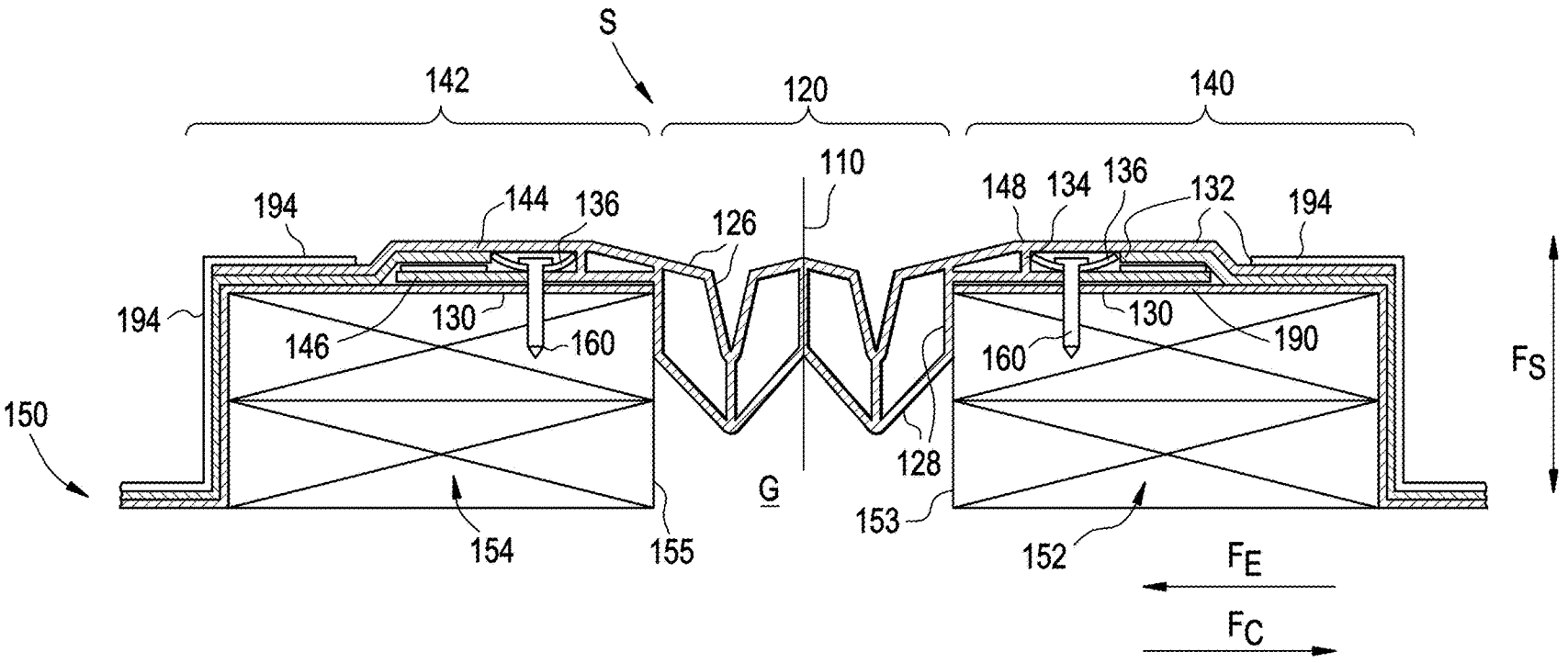
FIG. 4 is a cross-sectional view of the expansion joint seal of FIG. 3 as installed on two substantially parallel substrates.
Figure 5:
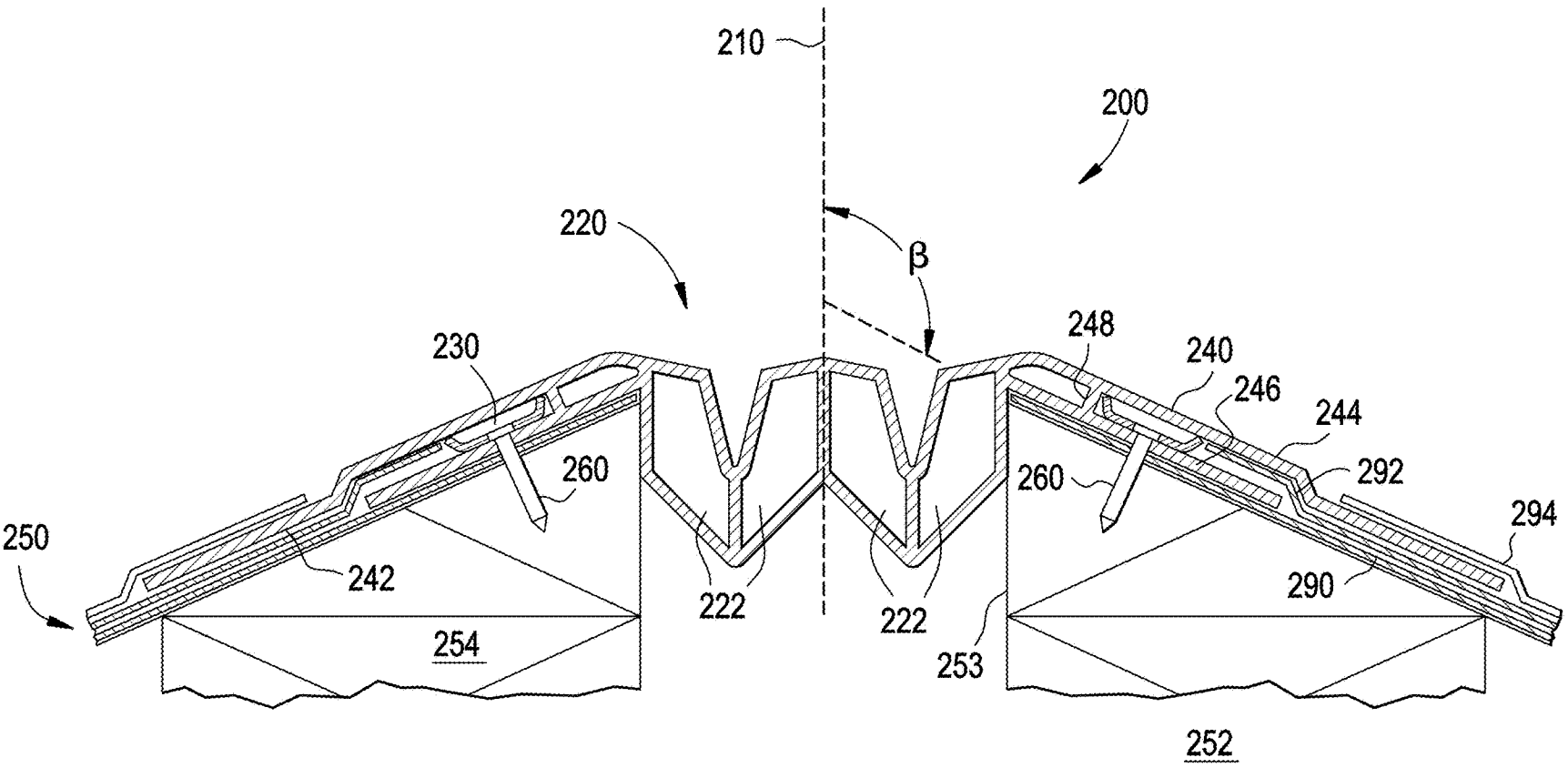
FIG. 5 is a cross-sectional view of the expansion joint seal of FIG. 3 as installed on two peaked or sloped substrates.
Figure 6:
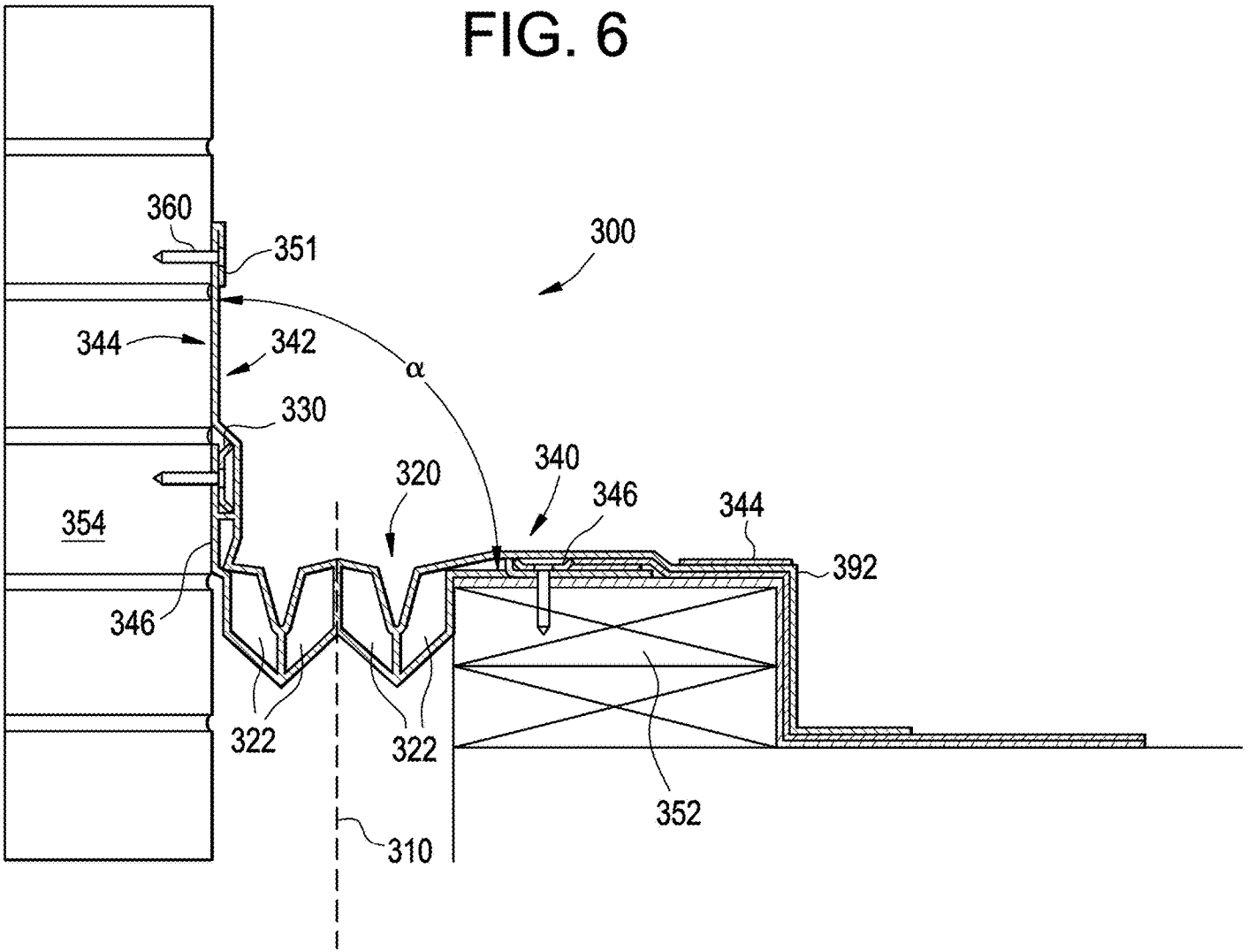
FIG. 6 is a cross-sectional view of the expansion joint seal of FIG. 3 as installed on two substantially perpendicular substrates.

Referring to FIG. 3, an expansion joint seal 100 comprises a central portion 120 disposed around a centerline 110 of the seal 100 and at least one of a first flange portion 140 and a second flange portion 142. A first continuous surface 102 of the joint seal 100 is defined by the center portion 120, the first flange portion 140, and the second flange portion 142. As described in detail below, when installed and affixed on a roof of a structure, the joint seal 100 is integrally incorporated with roofing materials on the roof such that the first surface 102 forms a seal S of a joint or gap G between structural elements of the roof (FIG. 4). As shown in FIG. 3, each of the first flange portion 140 and the second flange portion 142 extend outwardly from the centerline 110. As described above, in one embodiment the joint seal 100 is comprised of a flexible material such as, for example, a thermoplastic compound so that the first flange portion 140 and the second flange portion 142 may be affixed to a structure at differing angles and/or elevations relative to the central portion 120 and/or each other. For example, as shown in FIG. 4, the first flange portion 140 and the second flange portion 142 are coplanar in alignment at installation on structural elements 152 and 154 of a roof 150. In another installation as shown in FIG. 5, each of a first flange portion 240 and a second flange portion 242 of a joint seal 200 are installed at an angle 13, shown here at approximately one hundred ten degrees (110°) relative to a centerline 210 of the joint seal 200. In another installation as shown in FIG. 6, a first flange portion 340 and a second flange portion 342 of a joint seal 300 are formed at an angle $\alpha$ to each other shown here, for example, at ninety degrees (90°) relative to a centerline 310. It should be understood that the angles $\beta$ or $\alpha$ could be any degree relative to a centerline. It should further be understood that during use, the first flange portions 140, 240, 340 and the second flange portion 142, 242, 342 may move relative to the centerlines 110, 210, 310 despite the angles at initial installation. It should be appreciated that the roof expansion joint seals 200 (FIG. 5) and 300 (FIG. 6) are substantially similar to the roof expansion joint seal 100 of FIGS. 3 and 4. As such, similar numbering conventions are used to relate to similar components of these seals 100, 200 and 300.

As described below, the expansion joint seals 100, 200, 300, 400 (FIGS. 7 and 8), 500 (FIG. 9), 600 and 700 (FIG. 10) of the present invention are made from a flexible material. In one embodiment, the flexible material is a thermoplastic compound such as, for example, thermoplastic elastomers (TPEs) which could be of the families of thermoplastic vulcanizates (TPVs), such as Santoprene® (Exxon Mobil Corp., Irving, Tex.); or thermoplastic olefins (TPOs), such as OnFlex®(PolyOne Corp., Avon Lake, Ohio); or polyvinyl chloride (PVC) compounds such as FlexAlloy® (Teknor Apex Co., Pawtucket, R.I.). Thermoplastic rubber compounds are to preferable thermoset rubber compounds due to their ability to be welded to roof membrane materials of similar compounds as well as to facilitate the fabrication of heat-welded transitions in plane and direction. In one embodiment, the method of manufacture is extrusion because it permits a single cross-section design to be extended consistently throughout any desired length. In one embodiment, the expansion joint seals 100, 200, 300, 400, 500 and 600 are manufactured to fit the lengths of specific expansion joints.

Referring again to FIG. 3, in one embodiment, at least one of the first flange portion 140 and the second flange portion 142 is bifurcated into an upper flange portion 144 and a lower flange portion 146. In one embodiment, the upper flange portion 144 and the lower flange portion 146 are separated by a support wall 148 formed therebetween. As shown in FIG. 3, both the first flange portion 140 and the second flange portion 142 are bifurcated into the upper flange portion 144 and the lower flange portion 146, but it should be appreciated that this is not a requirement of the present invention. In one embodiment, the support wall 148 is substantially perpendicular to the upper flange portion 144 and the lower flange portion 146. In one embodiment, the support wall 148 extends the length of the expansion joint seal 100. In one embodiment illustrated in FIG. 8, an upper flange portion 440 of an expansion joint seal 400 (shown in partial cross section) is raised during installation so that the joint seal 400 may be affixed to a structure of interest 452 by one of a plurality of fasteners 460 affixed through a hole 441 in a lower flange portion 446 of the joint seal 400.

Figure 7:
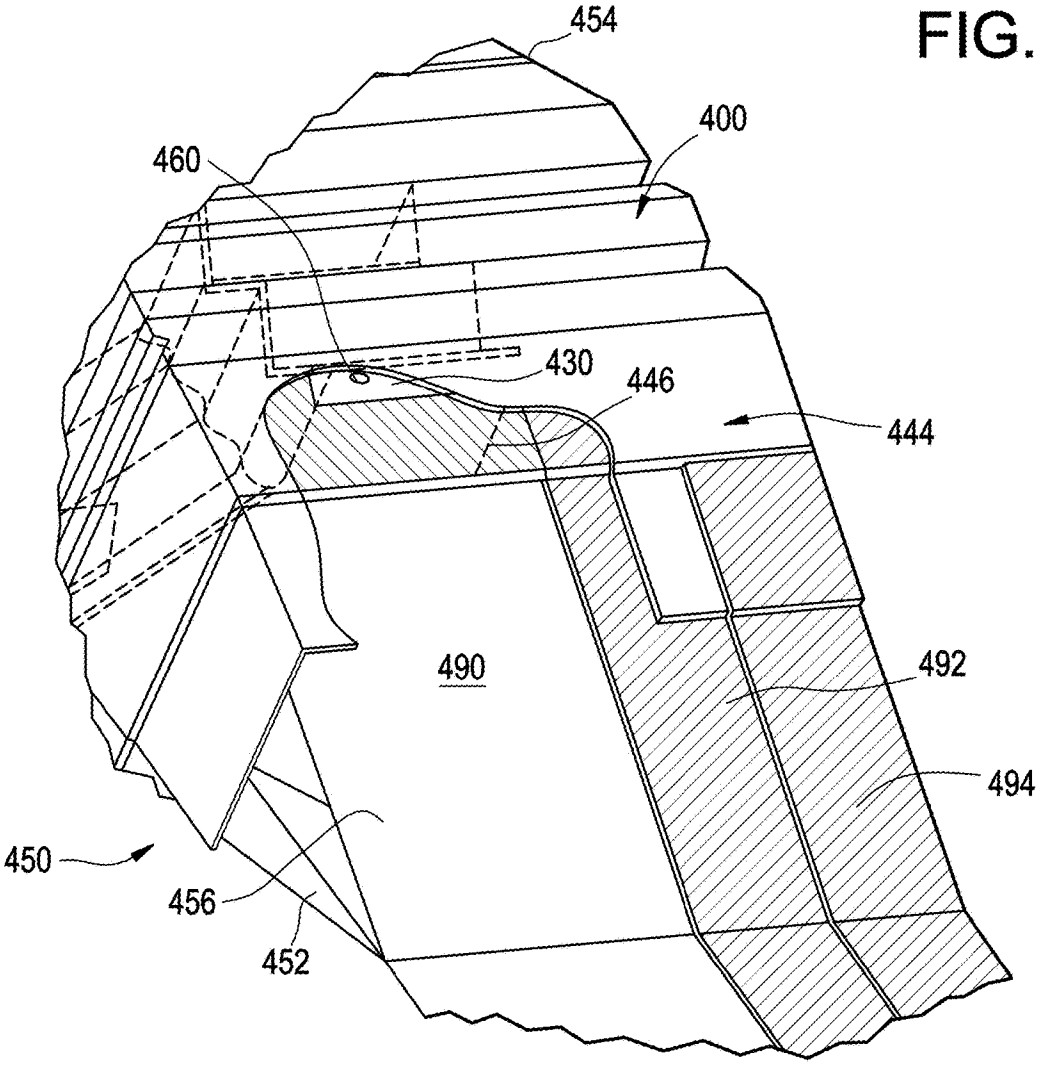
FIG. 7 is a perspective view of the expansion joint seal of FIG. 3 as installed showing an upper flange portion and a lower flange portion.
Figure 8:
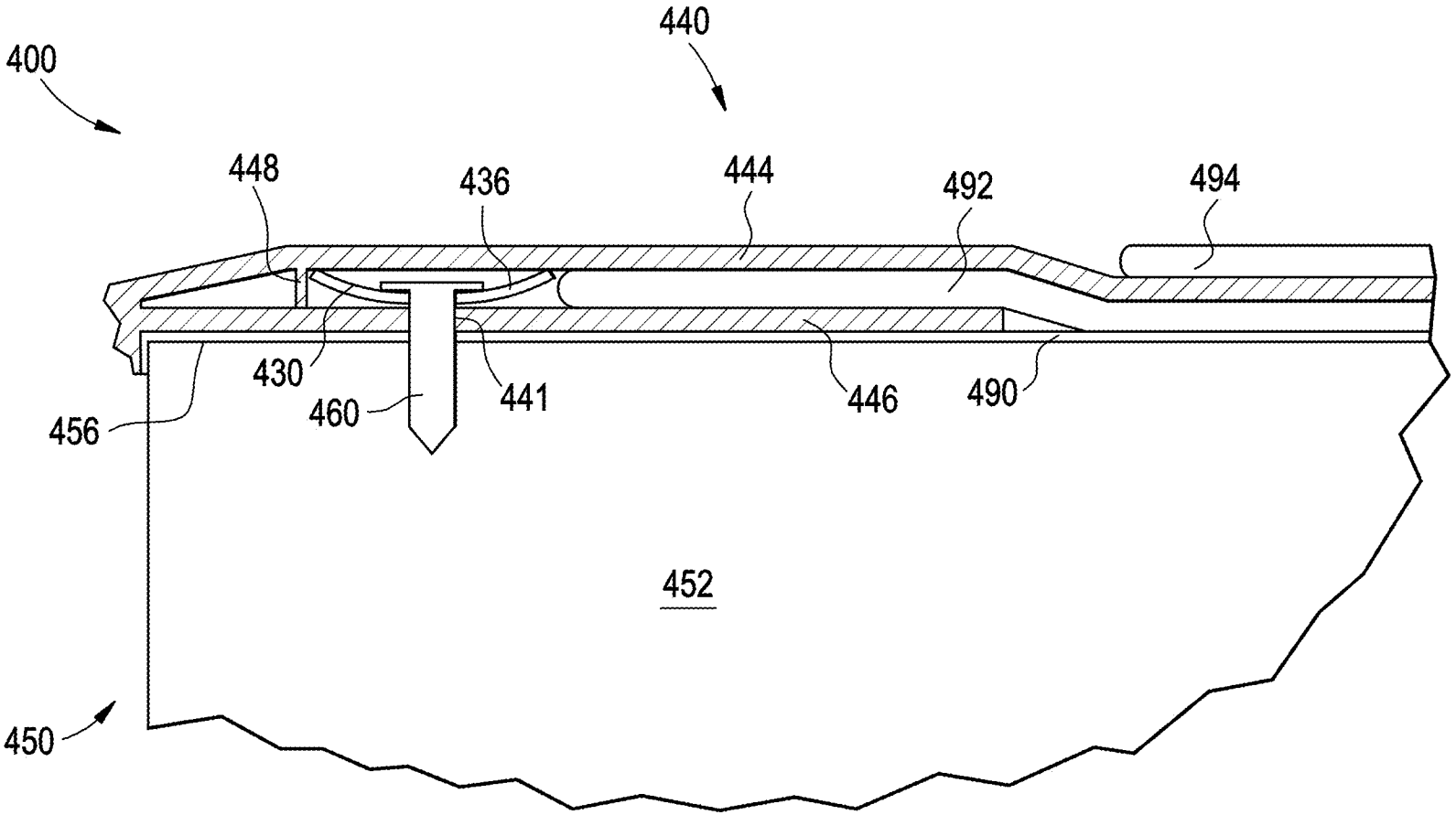
FIG. 8 is a partial cross-sectional view of a bracket (flange) with a fastener therethrough as used with the expansion joint seal of FIG. 3.

In one embodiment, as best illustrated in FIGS. 4, 5 and 8, the upper flange portion 144, 244, 444 extends further in length away from the centerline 110, 210, 410 of the joint seal 100, 200, 400 than the lower flange portion 146, 246, 446 such that the upper flange portion 144, 244, 444 cooperates with roofing materials 190, 290, 490 (e.g., in an interlaying manner) to provide a watertight seal with the roofing materials applied over the roof 150, 250, 450. The roofing materials are described in further detail below with reference to FIGS. 7 and 8. In another embodiment shown in FIG. 6, an upper flange portion 344 is secured to a structure of interest (e.g., a second substrate 354 of the structure) by a fastener 360 through a hole 351 in the upper flange portion 344.

Referring again to FIG. 3, the central portion 120 includes at least one central chamber 122. In one embodiment the central chamber 122 includes two or more chambers, e.g. four (4) chambers shown in FIG. 3. The central chamber 122 is formed by a side wall 124. In one embodiment, the central chamber 122 extends a length of the seal 100. In one embodiment, the side wall 124 of the central chamber 122 is configured to be selectively collapsible in response to forces exerted on the side wall 124. For example, in one embodiment, the side wall 124 of the central chamber 122 is configured into a generally pentagonal cross-section (e.g., five-sided cross-section). It should be understood that the shape of the central chambers 122, as defined by the side wall 124, can be of any selectively collapsible configuration that permits compression and expansion movement of the central chamber 122 in response to forces exerted on the side wall 124 while retaining, in an uninterrupted fashion, the first continuous surface 102 of the expansion joint seal 100. The number of central chambers 122 included within the central portion 120 can likewise be varied to accommodate different widths of expansion joint openings (e.g., widths of gap G (FIG. 4)). As shown in FIGS. 3 and 4, the side wall 124 includes a first outer surface 126 integrally formed within the first continuous surface 102 of the joint seal 100, and a second outer surface 128 opposite the first continuous surface 102. As forces from, for example, expansion ($F_E$) of the roof 150, and/or structural elements thereof 152 and 154, is exerted on the second outer surface 128 of the side wall 124, the central chamber 122 deforms or contracts (compresses) in response to the expansion force. Similarly, as forces from, for example, contraction ($F_C$) of the roof 150 is directed away from the second outer surface 128 of the side wall 124, the central chamber 122 deforms or expands in response to the contraction force.

As shown in FIG. 4, in one embodiment, the first flange portion 140 is affixed to a first substrate 152 of the roof 150 by one or more fasteners 160. The second flange portion 142 is affixed to a second substrate 154 by one or more of the fasteners 160. The central portion 120 is disposed within and fills a gap G in the roof 150 between the first substrate 152 and the second substrate 154, such as, for example, a structural expansion joint opening in the roof 150 of a structure. In one embodiment, when installed the outer surface 128 of the side wall 124 engages, for example, with an inner surface 153 of the first substrate 152 and an inner surface 155 of the second substrate 154. As one or both of the first substrate 152 and the second substrate 154 expands or contracts in response to, for example, one or more of thermal expansion or contraction, sway, settlement, live load deflections and/or seismic movement of the roof 150 and/or structural members thereof, the inner surfaces 153 and/or 155 exert forces toward (expansion $F_E$) or away from (contraction $F_C$) the outer surface 128, or perpendicular to (sway, settlement $F_S$) forces $F_E$ and $F_C$. The shape and position of the central chambers 122 allows the central portion 110 to expand and contract responsive to forces placed on the second outer surface 128 and the side wall 124 by the inner surfaces 153, 155 of the first substrate 152 and the second substrate 154, respectively, and maintain the seal S of the gap G. As shown in FIGS. 3-6, in one embodiment, the central portions 120, 220, 320 are comprised of four (4) central chambers 122, 222, 322 arranged in mirrored sets of two chambers opposite the center line 110, 210, 310.

Figure 9:
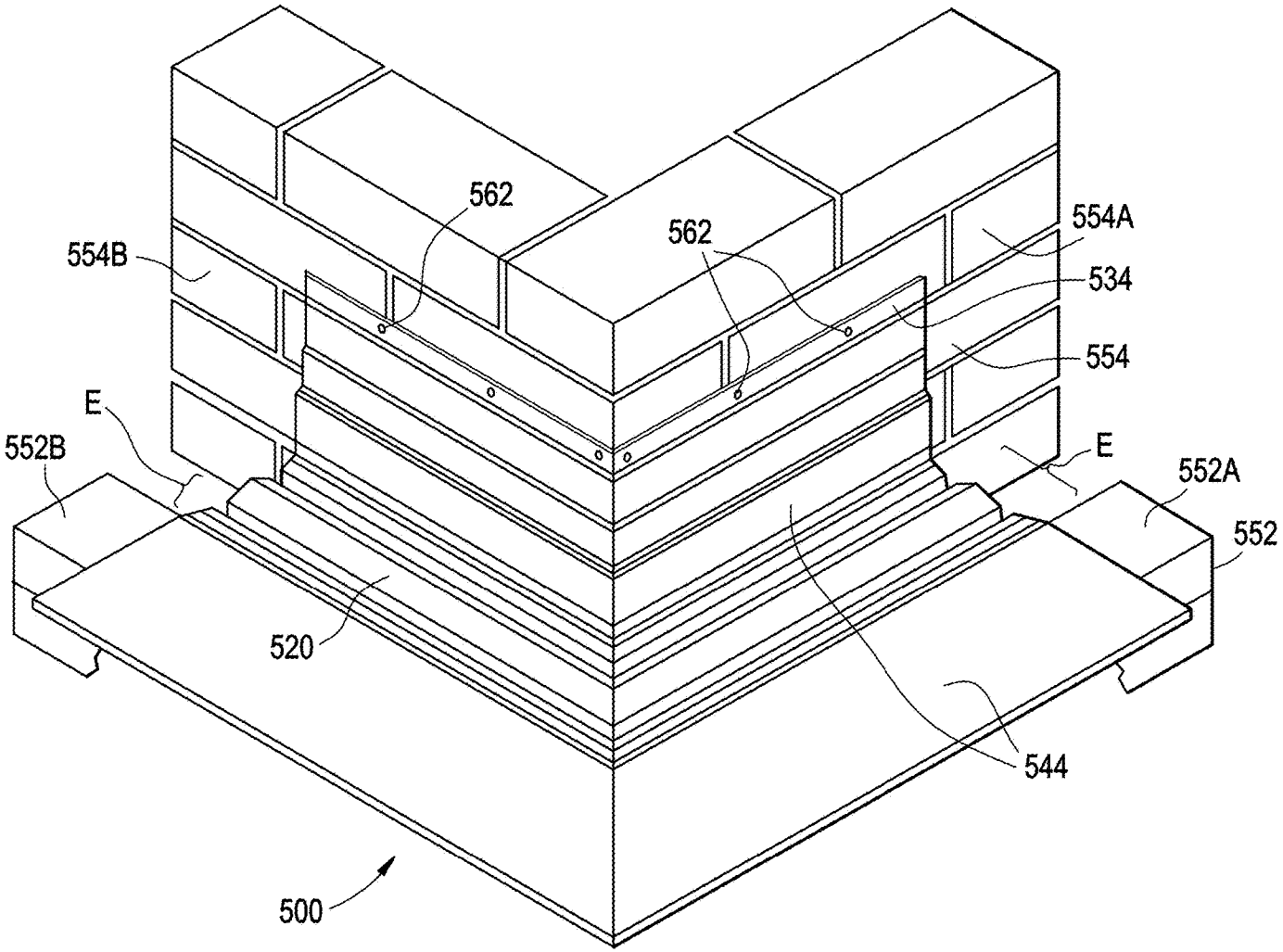
FIG. 9 is a perspective view of the expansion joint seal of FIG. 3 as installed around a corner.

As shown in FIG. 4, in one embodiment, an anchor bar 136 is disposed between the upper flange portion 144 and the lower flange portion 146 along a length of the seal 100. In one embodiment, the anchor bar 136 is comprised of sufficiently rigid material such as, for example, metal, a rigid polymer, or the like, to impart a clamping force continuously along the length of the lower flange portion 146 between the fasteners 160. Tool member 130 is also shown in FIG. 4. Referring to FIG. 8, an anchor bar 430, 436 is disposed between the upper flange portion 444 and the lower flange 446 and receives one or more fasteners 460. Roofing materials 490, 492, 494 are interlayed and cooperate with the upper flange portion 444 and the lower flange 446 to form a water tight seal of the roof 450. In one embodiment shown in FIG. 9, a roof joint seal 500 may be installed to a first substrate 552 such as, for example, a deck or flat roof portion, and a second substrate 554 such as, for example, a wall, to fill an expansion joint E therebetween. As shown in FIG. 9, the roof joint seal 500 may be configured to accommodate the expansion joint E that turns a corner. In another embodiment shown in FIG. 10, a joint seal 600 accommodates a T-intersection wherein it is attached to a first substrate 652, a second substrate 654 and a third substrate 656.

Referring to FIGS. 7 and 8, in one embodiment at least one of the first substrate 452 and the second substrate 454 are covered with a layer of the watertight roofing membrane 490 and engage for example, an upper surface 456 of the first substrate 452. In one embodiment, the lower flange portion 446 engages a first layer of the watertight roofing membrane 490. In another embodiment, the lower flange portions 446 are attached to the watertight roofing membrane 490 with a tar, adhesive of the like. In another embodiment, the lower flange portion 446 is attached to the first layer of the watertight roofing membrane 490 by welding. In another embodiment, the lower flange portion 446 is fixed to at least one of the first substrate 452 and the second substrate 454 by one of the plurality of fasteners 460 disposed through the hole 441 of the lower flange portion 446 and of the anchor bar 430. A second watertight roofing membrane 492 may then be disposed over the lower flange portions 446. In one embodiment, the second watertight roofing membrane 492 is heat-welded or otherwise adhered to the lower flange portion 446, effectively integrating the lower flange portion 446 into the roof membranes 490 and 492. In one embodiment, the upper flange portion 444 is disposed over the second water tight roofing membrane 492 and is heat-welded or otherwise adhered thereto. In this embodiment, the anchor bar 430 and the plurality of fasteners 460 are shielded from the harmful effects of moisture and environmental exposure by the upper flange portion 444. A third watertight roofing membrane 494 may then be disposed about at least a portion of the upper flange portion 444 and heat-welded or otherwise adhered thereto. This process provides a waterproof seal S over the joint by positively integrating the expansion joint seal 400 into the roofing materials (e.g., membranes 490, 492 and 494) of the roof 450.

Referring to FIG. 9, an expansion joint seal 500 is attached to a first portion 552A and a second portion 552B of a first substrate 552 forming a corner. A second substrate 554 extending vertically upward from the first substrate 552 also forms a corner having a first portion 554A and a second side portion 554B. An expansion joint between the first substrate 552 and the second substrate 554 is generally indicated at E. In one embodiment, an upper flange portion 544 is attached to the first portion 554A and the second portion 554B by an anchor bar 534 and a plurality of fasteners 562 disposed therethrough.

Figure 10:
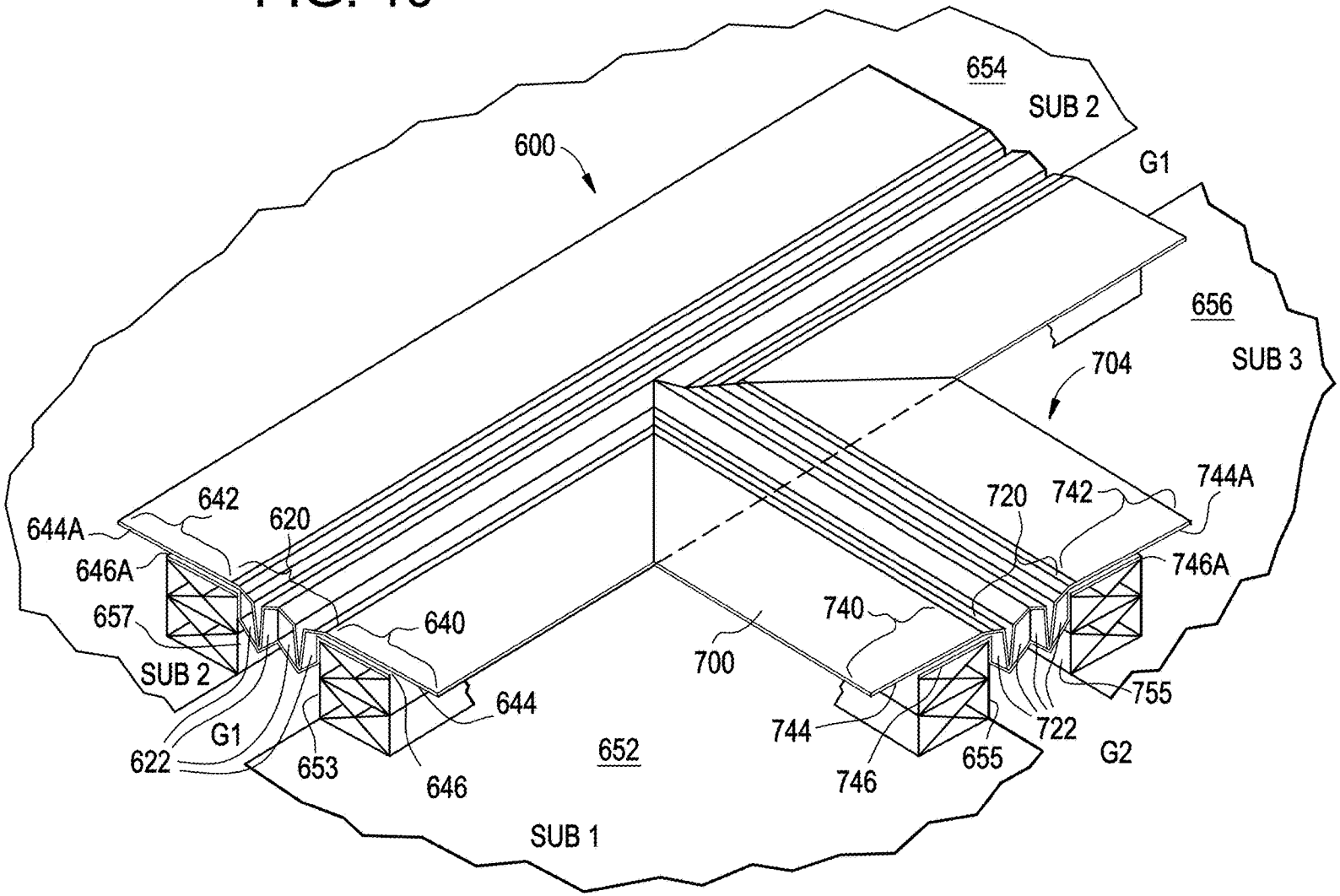
FIG. 10 is a perspective view of the expansion joint seal of FIG. 3 as installed at a T-intersection.

Referring to FIG. 10, expansion joint seals 600 and 700 are installed in a floor or deck having a T-shaped expansion joint or gaps G1 and G2. The expansion joint seal 600 is attached to a first substrate 652, a second substrate 654, and a third substrate 656. Similarly, the expansion joint seal 700 is attached to the first substrate 652 and the third substrate 656. In one embodiment, illustrated in FIG. 10, one or both of the expansion joint seals 600 and 700 are cut to taper at an intersection of the T-shaped joint or gaps G1 and G2. Alternatively, the expansion joint seal 700 is cut square to abut the expansion joint seal 600 at the intersection of T-shaped joint. As with the aforementioned expansion joint seals 100, 200, 300, 400, 500, central portions 620 and 720 of the expansion joint seals 600 and 700 are disposed in the gaps Gland G2 between side edges 653, 655, 657 and 755 of the first substrate 652, the second substrate 654 and the third substrate 656. In one embodiment, the expansion joint seal 600 and the expansion joint seal 700 are fused together, for example, with heat sealing or adhesive. The expansion joint seal 600 has a center portion 620 with four central chambers 622 formed therein and disposed within and sealing the gap G1. Similarly, the expansion joint seal 700 has a center portion 720 with four central chambers 722 formed therein and is disposed within and filling the gap G2. Still referring to FIG. 10, in one embodiment, when any one of the first substrate 652, the second substrate 654, and/or the third substrate 656 moves as a result of thermal expansion and contraction, wind sway, settlement, live load deflection, and/or seismic movement, the central portions 620 and/or 720 respond to maintain the watertight seal over the expansion joints G1 and/or G2.

Figure 11:
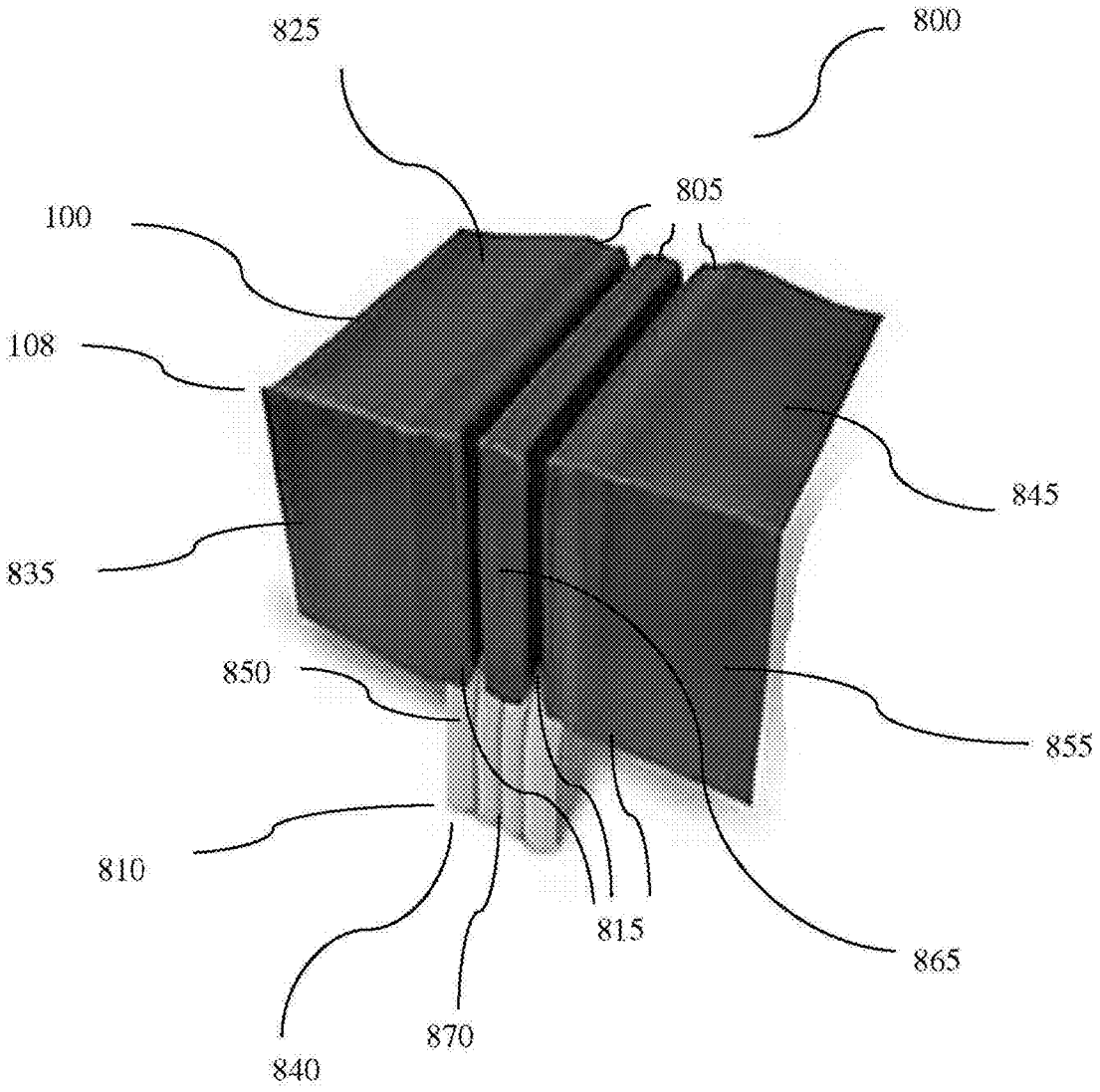
FIG. 11 is a perspective view of a watertight, integrated wall and roof expansion joint seal system comprising the expansion joint seal of FIG. 3 and a joint closure.
Figure 14:
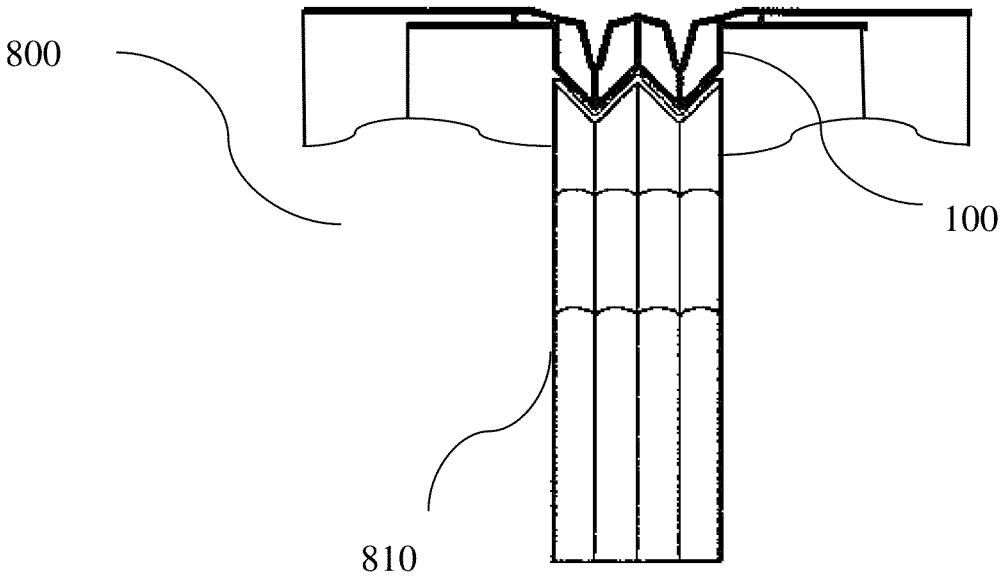
FIG. 14 is a partial, elevation view of the watertight, integrated wall and roof expansion joint seal system of FIG. 11.

As illustrated in, e.g., FIGS. 6 and 9 described above, embodiments of the present invention provide an integrated wall and roof expansion joint system. FIG. 11 illustrates another example of such a system. As shown therein, a watertight, integrated wall and roof expansion joint system 800 comprises an expansion joint seal such as, e.g., seal 100 shown in FIG. 3, and a joint closure 810. FIG. 14 schematically depicts a partial, elevation, end view of the watertight, integrated wall and roof expansion joint seal system 800 of FIG. 11.

Expansion joint seal 100 has been described above with respect to, e.g., FIG. 3. In FIGS. 11 and 14, however, expansion joint seal 100 is depicted with a bend or fold in the gland. Thus, movement at the joint can be accommodated by the folding design of the gland. The bend or fold can be configured to form any suitable angle such as about 45 degrees, 90 degrees and so forth, as further described below.

According to embodiments, the inventors have solved the problem of how to obtain a watertight transition from a roof to a wall expansion joint. Advantageously, according to embodiments and as best seen in FIG. 11, a solution lies in the expansion joint seal 100 configured to be seated in a joint-gap, a factory welded downturn transition in the gland of the seal 100 that is sealed at, e.g., about a 45 degree angle to mate with an interlocking factory fabricated transition piece (joint closure 810) made of, e.g., SEISMIC COLORSEAL. The result is an integrated wall and roof expansion joint system 800 that is watertight.

As shown in FIG. 11, watertight, integrated wall and roof expansion joint seal system 800 comprises an expansion joint seal 100 comprising a fold 108. The fold 108 comprises a first fold portion 805 shown, e.g., as a top portion, and a second fold portion 815 shown, e.g., as a side portion, wherein a first fold portion of the first flange portion 825 is attachable to a first surface of a first substrate of a structure and a second fold portion of the first flange portion 835 is attachable to a second surface of the first substrate, and a first fold portion of the second flange portion 845 is attachable to a first surface of a second substrate of the structure and a second fold portion of the second flange portion 855 is attachable to a second surface of the second substrate. The central portion 865 is disposed within and seals a gap formed between the first substrate and the second substrate of the structure.

Figure 11A:
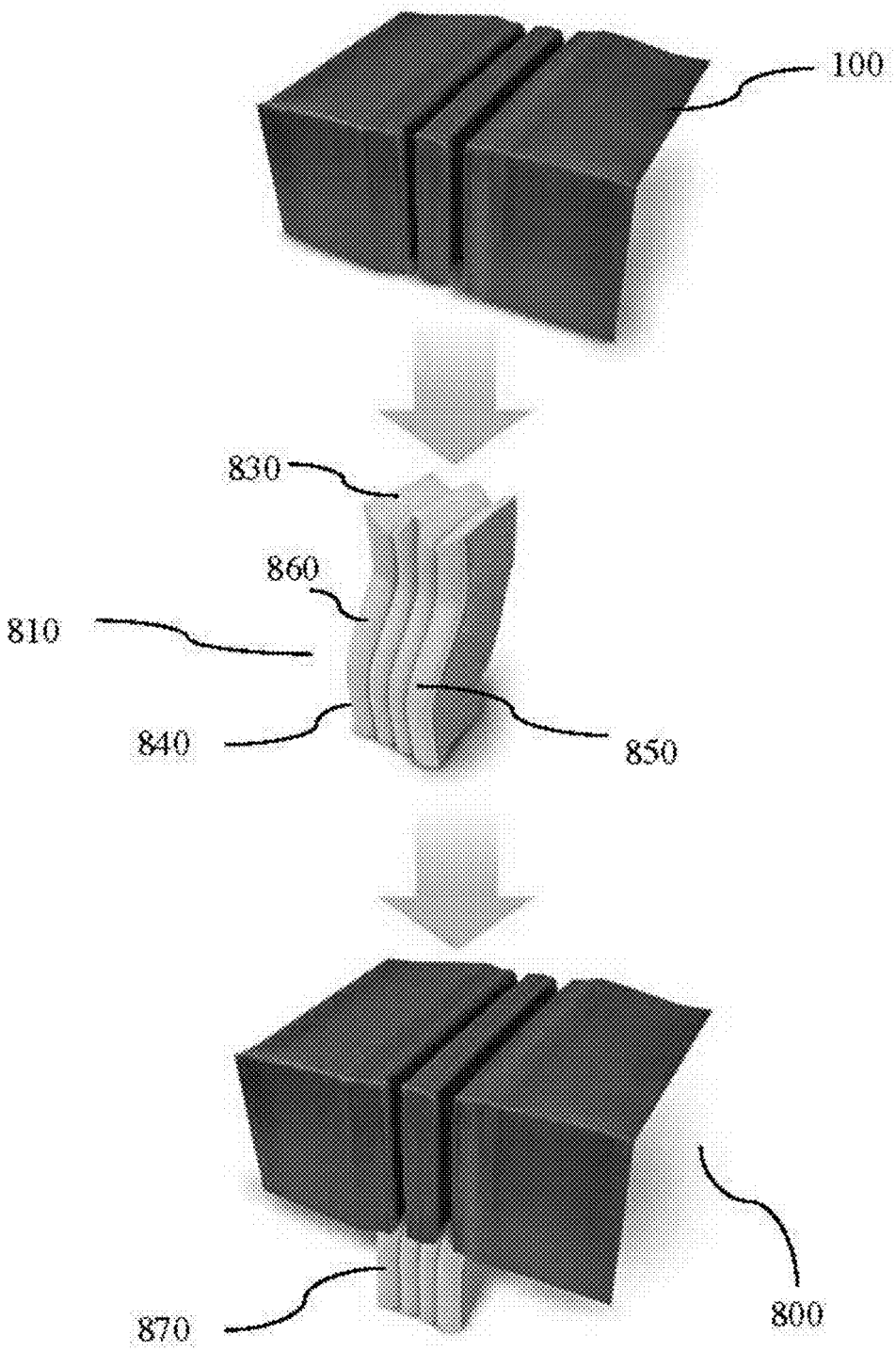
FIGS. 11A and 11B illustrate the integration of the expansion joint seal with the joint closure, according to embodiments.
Figure 11B:
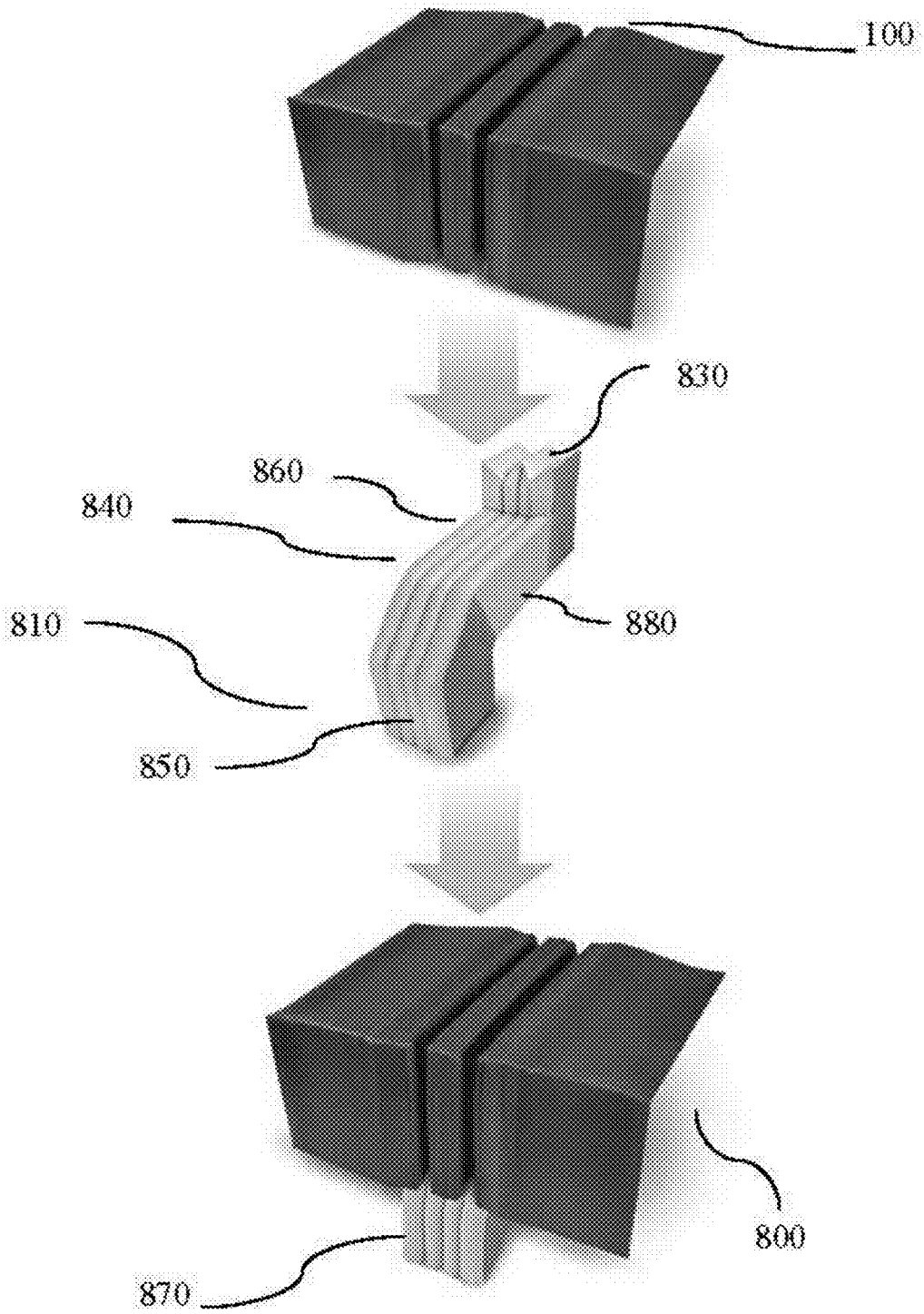
Figure 12:
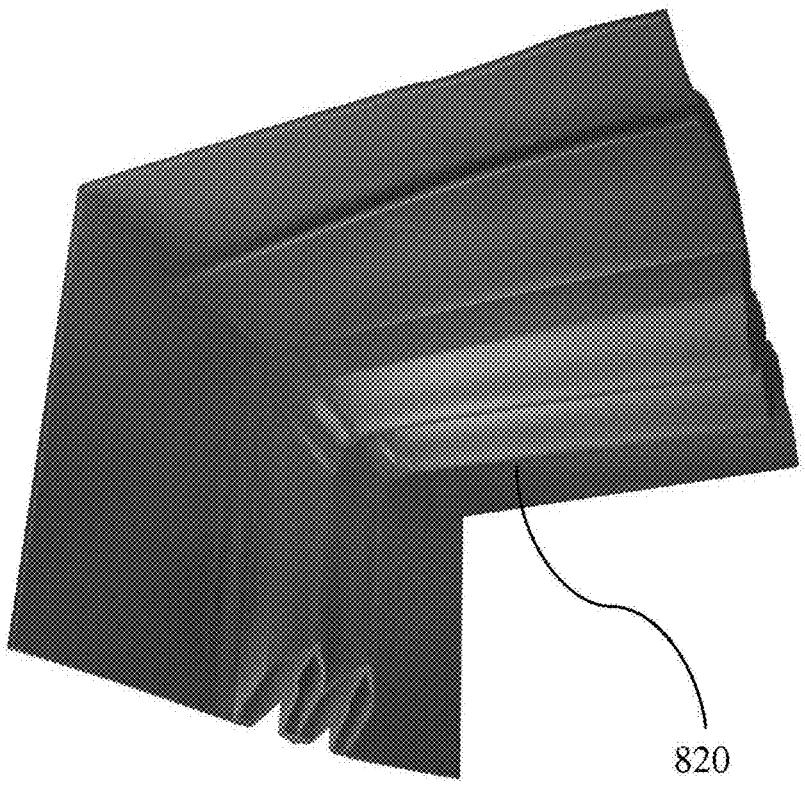
FIG. 12 is a perspective view of the underside of the expansion joint seal depicted in FIG. 11.

The expansion joint seal 100 of FIG. 11 is integrated with the joint closure 810 as shown, e.g., in FIGS. 11A and 11B to form the watertight, integrated wall and roof expansion joint seal system 800. FIG. 12 depicts the underside 820 of the expansion joint seal 100 of FIG. 11 which is integrated with an end portion 830 of the joint closure 810 as shown, e.g., in the embodiments of FIGS. 11A and 11B.

Joint closure 810 can comprise any suitable shape, size and thickness. As shown in FIGS. 11A and 11B, according to embodiments, end portion 830 of the joint closure 810 is shaped to match the underside of seal 100 of FIG. 11. Joint closure 810 comprises a core 840 and a layer of elastomer 850 on the core 840, wherein the layer of elastomer 850 is tooled to define a profile to facilitate compression by, e.g., thermal and/or seismic expansion and contraction of the system 800. The core 840 and the layer of elastomer 850 disposed thereon form an elongated section 860 (transition piece) of desired shape, size and material depending upon application and use. Examples of materials for core 840 include, but are not limited to, foam, e.g., polyurethane foam and/or polyether foam, and the core 840 can be of an open celled or dense, closed cell construction. Core 840 is not limited to a foam construction, as core 840 can be made of any suitable material. Further examples of materials for core 840 include, paper based products, cardboard, metal, plastics, thermoplastics, dense closed cell foam including polyurethane and polyether closed cell foam, cross-linked foam, neoprene foam rubber, urethane, and/or composites. Combinations of any of the foregoing materials or other suitable materials for the core 840 can also be employed.

The core 840 can be infused with a suitable material including, but not limited to, waterproofing material such as an acrylic, such as a water-based acrylic chemistry, a wax, a fire retardant material, ultraviolet (UV) stabilizers, and/or polymeric materials, and so forth. As an example, core 840 can comprise an open celled foam infused with a water-based acrylic chemistry, and/or a fire retardant material. One type of fire retardant material that may be used is a water-based aluminum tri-hydrate (also known as aluminum tri-hydroxide (ATH)). However, the present invention is not limited in this regard, as other fire retardant materials may be used. Such materials include, but are not limited to, metal oxides and other metal hydroxides, aluminum oxides, antimony oxides and hydroxides, iron compounds, such as ferrocene, molybdenum trioxide, nitrogen-based compounds, combinations of the foregoing materials, and other compounds capable of suppressing combustion and smoke formation.

As shown in FIG. 11, the core 840 can comprise individual laminations 870 of the core material, e.g., foam, one or more of which can be infused with a suitable amount of the acrylic and/or fire retardant material and/or other desired material, such as wax, and so forth. For example, individual laminations 870 can extend substantially parallel to each other and can be constructed by infusing each desired laminate with a suitable amount of, e.g., acrylic and/or fire retardant material. It should be noted that the present invention is not so limited as other manners of constructing the core 840 are also possible. For example, the core 840 is not limited to individual laminations 870 assembled to construct the laminate, as the core 840 may comprise a solid block of non-laminated foam or other suitable material of fixed size depending upon the desired joint size.

As a non-limiting example, the amount of fire retardant material infused into the core 840, such as an open celled foam, is between 3.5:1 and 4:1 by weight in a ratio with the un-infused core itself. The resultant uncompressed core whether comprising a solid block or laminates, has a density of about 130 kg/m$^3$ to about 150 kg/m$^3$, specifically 140 kg/m$^3$, according to embodiments.

The infused core 840, such as infused foam laminate, can be constructed in a manner which insures that substantially the same density of fire retardant is present in the product regardless of the final size of the product. For example, the starting density of the infused foam is approximately 140 kg/m$^3$, according to embodiments. After compression, the infused foam density is in the range of 200-700 kg/m$^3$. After installation, the laminate can cycle between densities of approximately 750 kg/m$^3$ at the smallest size of the expansion joint to approximately 400-450 kg/m$^3$ or less at the maximum size of the joint. This density of 400-450 kg/m$^3$ is based upon experiments as a reasonable minimum which still affords adequate fire retardant capacity, such that the resultant composite can pass the UL 2079 test program. The present invention is not limited to cycling in the foregoing ranges, however, as the material may attain densities outside of the herein described ranges. It is further noted that UL 2079, developed by Underwriters Laboratories, is a further refinement of ASTM E-119 by adding a cycling regimen to the test. Additionally, UL 2079 stipulates that the design be tested at a maximum joint size. This test is more reflective of real world conditions, and as such, architects and engineers have begun requesting expansion joint products that meet it. Many designs which pass ASTME-119 without the cycling regime do not pass UL 2079. This may be adequate for non-moving building joints; however, most building expansion joint systems are designed to accommodate some movements as a result of thermal effects (e.g., expansion into the joint and contraction away from the joint) or as a result of seismic movement. Advantageously, embodiments of the systems disclosed herein meet and can pass UL 2079 testing. Thus, embodiments of the systems disclosed herein are capable of withstanding exposure to a temperature of at least of about 540° C. for about five minutes, capable of withstanding exposure to a temperature of about 1010° C. for about two hours, capable of withstanding exposure to a temperature of about 930° C. for about one hour, and capable of withstanding exposure to a temperature of about 1260° C. for about eight hours.

In any embodiment, for example when individual laminations 870 are used, several laminations, the number depending on the expansion joint size (e.g., the width, which depends on the distance between opposing substrates into which the expansion joint system 800 is to be installed), can be compiled and then compressed and held at such compression in a suitable fixture. The fixture, referred to as a coating fixture, is typically at a width slightly greater than that which the expansion joint will experience at the greatest possible movement thereof.

It is noted that in the fixture, the laminations 870 can be configured in any desired shape and size depending upon the desired application and end use. For example, the laminations 870 thus can be configured and factory fabricated, with use of a fixture, as a substantially straight portion of the elongated section 860 or in other configurations.

According to embodiments, in the fixture for instance, the assembled infused or un-infused core 840 is typically coated with waterproof elastomer 850 on, for example, one or more surface. The elastomer 850 may comprise, for example, at least one polysulfide, silicone, acrylic, polyurethane, polyepoxide, silyl-terminated polyether, combinations and formulations thereof, and so forth, with or with or without other elastomeric components, coatings, liquid sealant materials, and so forth. Further examples of elastomer 850 for coating, e.g., laminations 870 include PECORA 301 (available from Pecora Corporation, Harleysville, Pa.), DOW 888 (available from Dow Corning Corporation, Midland, Mich.), DOW 790 (available from Dow Corning Corporation, Midland, Mich.), DOW 795 (also available from Dow Corning Corporation), PECORA 890 (available from Pecora Corporation, Harleysville, Pa.), and so forth. A primer may be used depending on the nature of the adhesive characteristics of the elastomer 850.

During or after application of the elastomer 850 to, e.g., laminations 870, the elastomer 850 can tooled or otherwise configured to create a "bellows," "bullet," or other suitable profile. The profile can be of any suitable size and dimension. As a non-limiting example, widths less than about 1 inch have a convex single bellows surface. As a further non-limiting example, widths between about 1 inch and about 4 inches have a dual bellow surface. It is noted that the layer of elastomer 850 also can be continuous or non-continuous over the elongated section 860.

Figure 15:
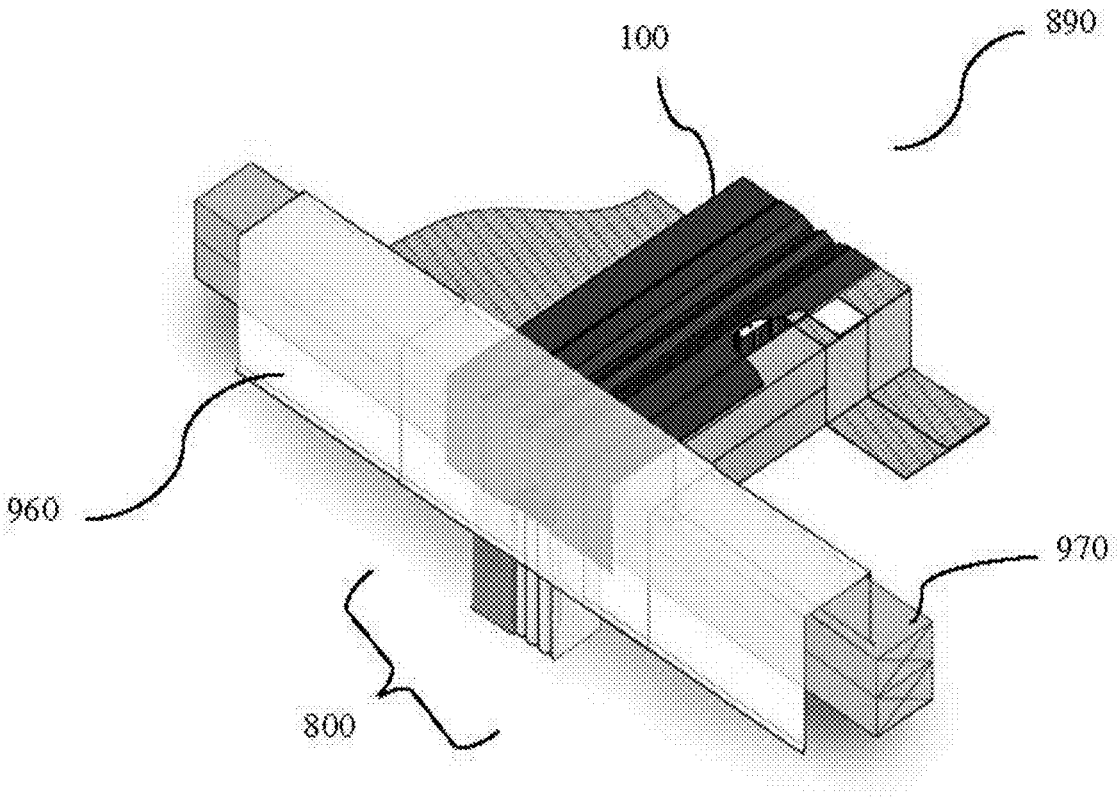
FIG. 15 is a perspective view of a construction assembly comprising the watertight, integrated wall and roof expansion joint seal system of FIG. 11 and employing the joint closure of FIG. 11A in a solid to wall roof closure application.

As noted above, the joint closure 810 comprising core 840 and elongated section 860 can be constructed in any suitable shape and size depending upon application and use such as, e.g., depending upon whether the application is a solid to wall or a cavity to wall sealing application. For example, FIG. 15 illustrates a perspective view of a construction assembly 890 comprising the watertight, integrated wall and roof expansion joint seal system 800 of FIG. 11 and employing the joint closure 810 of FIG. 11A in a solid to wall roof closure application. In this application, joint closure 810 can comprise a 45 degree miter to match a 45 degree miter of the seal 100. As further shown in FIG. 15, wood block nailer 970 can be employed with a roof parapet break-metal flashing cap 960, with an overlap in the break-metal flashing cap 960 to allow for movement.

FIG. 16 is a perspective view of the expansion joint seal system of FIG. 11 as installed in another solid to wall roof closure application (shown in FIG. 16A) and employing a joint closure 810 configured as a solid to wall transition piece (shown in FIG. 16B). As shown in FIG. 16B, the joint closure 810 can also comprise, e.g., a 45 degree miter, according to embodiments. It is noted that the upper and lower flange portions of FIG. 16 are also shown in detail in FIG. 7 and described above with respect to FIG. 7.

As a non-limiting example, in the solid to wall roof closure applications describe above with respect to, e.g., the as installed embodiment of FIG. 16A, a factory fabricated joint closure 810 can be manufactured from SEISMIC COLORSEAL wall expansion joint material sold by the subject Assignee, Emseal. This single unit piece has factory-coated silicone bellows on the top and upper back faces for integration with SEISMIC COLORSEAL in the wall and HORIZONTAL COLORSEAL, also sold by Emseal, as a secondary seal and insulator across the roof. According to embodiments, the silicone-coated top side (end portion 830) of the joint closure 810 is shaped to match the underside of the seal 100, as explained above.

FIG. 17 is a perspective view of the expansion joint seal system of FIG. 11 as installed in a cavity to wall roof closure application (shown in FIG. 17A) and employing a joint closure 810 configured as a cavity to wall transition piece (shown in FIG. 17B). As shown in FIG. 17B, the joint closure 810 also can comprise, e.g., a 45 degree miter, according to embodiments, and can be a factory-fabricated transition piece made from SEISMIC COLORSEAL. Joint closure 810 of FIG. 17B, also comprises a horizontal setback portion 880 to bridge a cavity 875 from, e.g., a structural backup wall 900 to a facade 910, as shown in FIG. 17. The sides of the "bridge" can be additionally coated with an elastomer 850, such as silicone, to seal them against moisture in the cavity 875 and to constrain the lateral expansion of the core 840 into the cavity.

Figure 13:
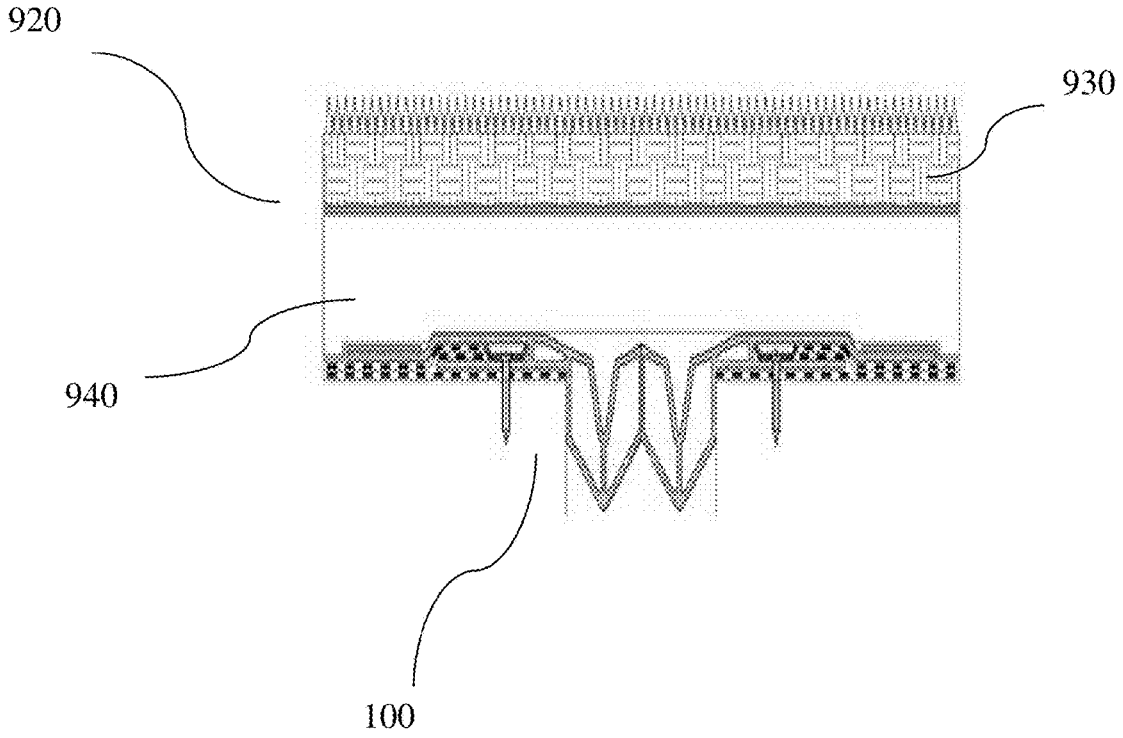
FIG. 13 is cross-section view of a garden roof assembly comprising the expansion joint seal of FIG. 3.

Thus, advantageously, according to embodiments of the invention, continuity of seal is extended to roof-to-wall configurations. Additionally, according to embodiments, the continuity of seal can also extend to, e.g., crosses, tees, upturns, downturns, and other conditions typically found in constructions projects. Moreover, embodiments of the invention are also suited for use in sealing structural slabs beneath, e.g., green, vegetative roof layers 940, as shown in FIG. 13 which illustrates a cross-section view of a garden roof assembly 920 comprising the expansion joint system 100 of FIG. 3. As the growing medium 930 is typically loose, compressible and granular, movement that occurs at the structural slab can be absorbed without detrimental effect in the green roof overburden. It is noted that growing medium 930 includes, but is not limited to soil, grass, vegetables, plants, flowers, and so forth.

Figure 18:
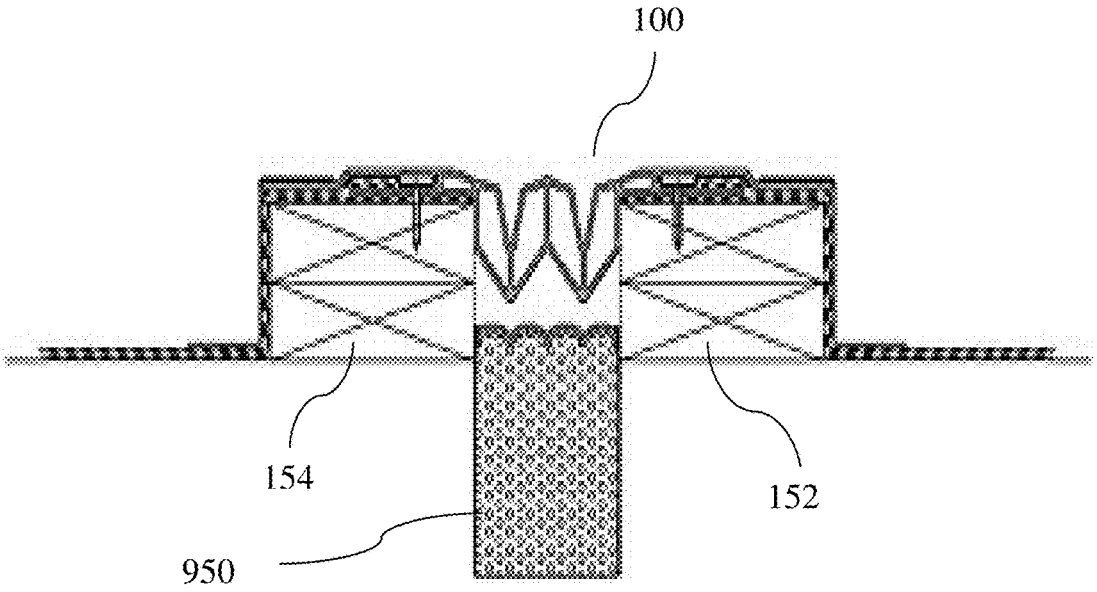
FIG. 18 illustrates the expansion joint seal depicted in FIG. 4 as installed and comprising a watertight barrier beneath the seal.

A further advantage of embodiments of the invention is in providing insulation in the joint openings beneath a roof expansion joint to maintain energy efficiency in the structure. For example, as shown in FIG. 18, depicted therein is the expansion joint seal 100 of FIG. 4 as installed on the substantially parallel substrates, and further comprising a watertight barrier beneath 950 the seal 100. The watertight barrier 950 may be any suitable materials, such as described above with respect to core 840. Typically, watertight barrier 950 comprises HORIZONTAL COLORSEAL from Emseal, as described above. An advantage of this solution is that in addition to insulating, the HORIZONTAL COLORSEAL provides an additional watertight barrier beneath the expansion joint seal 100 that can also be employed with a transition piece (joint closure 810 comprising core 840) of, e.g., SEISMIC COLORSEAL, also described above, to further ensure, e.g., continuity of seal and insulation with the wall joint.

Figure 19:
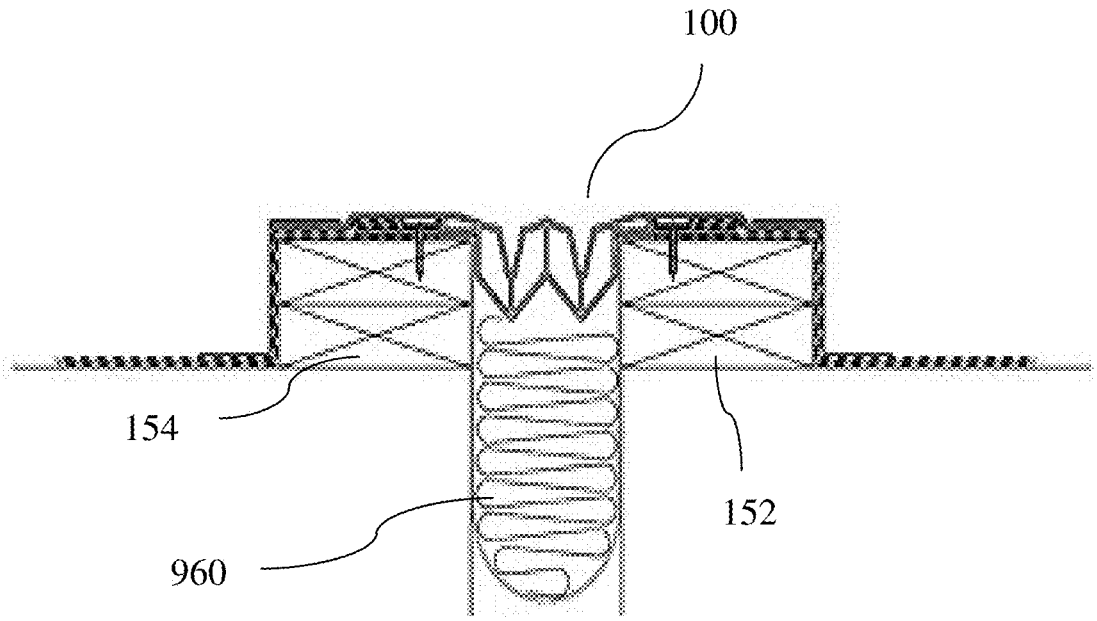
FIG. 19 illustrates the expansion joint seal depicted in FIG. 4 as installed and comprising a looped membrane of insulation beneath the seal.

FIG. 19 illustrates a further embodiment providing insulation in the joint openings beneath a roof expansion joint. For example, as shown in FIG. 19, depicted therein in the expansion joint seal 100 of FIG. 4 as installed on the substantially parallel substrates, and further comprising, e.g., batt insulation and looped membrane 960. A looped membrane 960 of suitable roofing material can be installed to support, e.g., fiberglass and/or mineral wool insulation batts, before installation of the expansion joint seal.

While the invention has been described with reference to various exemplary embodiments, it will be understood by those skilled in the art that various changes may be made and equivalents may be substituted for elements thereof without departing from the scope of the invention. Moreover, the embodiments disclosed herein can be employed in any combination with each other. In addition, many modifications may be made to adapt a particular situation or matter to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A watertight, integrated wall and roof expansion joint seal system comprising:

a) an expansion joint seal for a structure, the seal comprising:

a central portion having an underside and including a sidewall comprising members, the sidewall configured to define at least one central chamber disposed around a centerline;

a first flange portion extending outwardly from the centerline; and a second flange portion extending outwardly from the centerline in a direction opposite the first flange portion;

wherein at least one of the first flange portion and the second flange portion is bifurcated into an upper flange portion and a lower flange portion, the upper flange portion extending further in length from the centerline than the lower flange portion, and the lower flange portion being substantially parallel to the upper flange portion, the thickness of each of the upper flange portion and the lower flange portion being planar and substantially the same as the thickness of the members of the sidewall;

a fold comprising a first fold portion and a second fold portion, wherein the first fold portion of the first flange portion is attachable to a first surface of a first substrate of the structure and the second fold portion of the first flange portion is attachable to a second surface of the first substrate, and the first fold portion of the second flange portion is attachable to a first surface of a second substrate of the structure and the second fold portion of the second flange portion is attachable to a second surface of the second substrate, such that the central portion is disposed within and seals a gap formed between the first substrate and the second substrate of the structure; and b) a joint closure comprising a core and a layer of elastomer disposed on the core, the joint closure further comprising an end portion configured to match and integrate with the underside of the central portion to form the watertight, integrated wall and roof expansion joint system;

wherein movement of one or both of the first substrate and the second substrate causes a response in the central portion to maintain the seal.

2. The watertight, integrated wall and roof expansion joint seal system of claim 1, wherein at least one of the first flange portion and the second flange portion is comprised of a flexible material such that the at least one of the first flange portion and the second flange portion may be affixed to the structure at an angle or an elevation that differs from the central portion.

3. The watertight, integrated wall and roof expansion joint seal system of claim 1, further including a bracket disposed between the upper flange portion and the lower flange portion to facilitate mounting of the expansion joint seal to the structure.

4. The watertight, integrated wall and roof expansion joint seal system of claim 1, wherein when installed the upper flange portion and the lower flange portion interlay with two or more layers of roofing materials.

5. The watertight, integrated wall and roof expansion joint seal system of claim 1, wherein expansion of at least one of the first substrate and second substrate causes the central portion to deflect upward such that the central portion does not impinge on itself or prevent movement of one or both of the first substrate and the second substrate while maintaining the seal.

6. The watertight, integrated wall and roof expansion joint seal system of claim 1 wherein contraction of at least one of the first substrate and the second substrate causes the central portion to deflect downward such that the central portion does not impinge on itself or prevent movement of one or both of the first substrate and the second substrate while maintaining the seal.

7. The watertight, integrated wall and roof expansion joint seal system of claim 1 wherein the central portion includes a sidewall, the sidewall configured to define the at least one central chamber, the at least one central chamber being configured to be selectively collapsible in response to a force from movement of one or both of the first substrate and the second substrate.

8. The watertight, integrated wall and roof expansion joint seal system of claim 7 wherein the at least one central chamber is comprised of at least one pair of central chambers disposed about the centerline.

9. The watertight, integrated wall and roof expansion joint seal system of claim 1 wherein the at least one central chamber is comprised of an odd number of central chambers.

10. The watertight, integrated wall and roof expansion joint seal system of claim 1, wherein the core comprises open celled foam comprising a plurality of individual laminations assembled to construct a laminate, one or more of the laminations being infused with at least one of a fire retardant material and an acrylic, and a layer of elastomeric coating is located on the core.

11. The watertight, integrated wall and roof expansion joint seal system of claim 10, wherein the core comprises an elongated section comprising a horizontal setback portion configured to bridge a gap between a structural wall and a façade.

12. The watertight, integrated wall and roof expansion joint seal system of claim 11, wherein the elongated section comprises an elastomeric coated 45 degree miter.

13. An expansion joint seal system for a structure, comprising:

a) an expansion joint seal comprising:

a central portion including a sidewall comprising members, the sidewall configured to define at least one central chamber disposed around a centerline;

a first flange portion extending outwardly from the centerline; and a second flange portion extending outwardly from the centerline in a direction opposite the first flange portion;

wherein at least one of the first flange portion and the second flange portion is bifurcated into an upper flange portion and a lower flange portion, the upper flange portion extending further in length from the centerline than the lower flange portion, and the lower flange portion being substantially parallel to the upper flange portion, the thickness of each of the upper flange portion and the lower flange portion being planar and substantially the same as the thickness of the members of the sidewall;

a fold comprising a first fold portion and a second fold portion, wherein the first fold portion of the first flange portion is attachable to a first surface of a first substrate of the structure and the second fold portion of the first flange portion is attachable to a second surface of the first substrate, and the first fold portion of the second flange portion is attachable to a first surface of a second substrate of the structure and the second fold portion of the second flange portion is attachable to a second surface of the second substrate, such that the central portion is disposed within and seals a gap formed between the first substrate and the second substrate of the structure; and b) a watertight barrier located beneath the central portion and between the first substrate and the second substrate forming a watertight seal between the first substrate and the second substrate;

wherein movement of one or more of the first substrate and the second substrate causes a response in the central portion and in the watertight barrier to maintain the seal.

14. The expansion joint seal system of claim 13, wherein the watertight barrier comprises a core, the core comprising open celled foam comprising a plurality of individual laminations assembled to construct a laminate, one or more of the laminations being infused with at least one of a fire retardant material and an acrylic, and a layer of elastomeric coating is located on the core.

15. An expansion joint seal system comprising:

a) an expansion joint seal for a structure, the seal comprising:

a central portion including a sidewall comprising members, the sidewall configured to define at least one central chamber disposed around a centerline;

a first flange portion extending outwardly from the centerline; and a second flange portion extending outwardly from the centerline in a direction opposite the first flange portion;

wherein at least one of the first flange portion and the second flange portion is bifurcated into an upper flange portion and a lower flange portion, the upper flange portion extending further in length from the centerline than the lower flange portion, and the lower flange portion being substantially parallel to the upper flange portion, the thickness of each of the upper flange portion and the lower flange portion being planar and substantially the same as the thickness of the members of the sidewall;

wherein when installed on the structure the first flange portion is attachable to a first substrate of the structure and the second flange portion is attachable to a second substrate of the structure such that the central portion is disposed within and seals a gap formed between the first substrate and the second substrate of the structure;

wherein movement of one or both of the first substrate and the second substrate causes a response in the central portion to maintain the seal; and b) at least one of i) a watertight barrier located beneath the central portion and between the first substrate and the second substrate forming a watertight seal between the first substrate and the second substrate, and ii) an insulation batt and a looped membrane of roofing material located beneath the central portion and between the first substrate and the second substrate forming an insulating seal between the first substrate and the second substrate.

* * * * *